US009612570B2

(12) United States Patent
Noda et al.

(10) Patent No.: US 9,612,570 B2
(45) Date of Patent: Apr. 4, 2017

(54) PROCESS CARTRIDGE AND PHOTOSENSITIVE MEMBER CARTRIDGE

(71) Applicant: Brother Kogyo Kabushiki Kaisha, Nagoya-shi, Aichi-ken (JP)

(72) Inventors: Ryuji Noda, Seto (JP); Satoru Ishikawa, Kitanagoya (JP); Tokifumi Tanaka, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/590,195

(22) Filed: Jan. 6, 2015

(65) Prior Publication Data

US 2015/0192894 A1 Jul. 9, 2015

(30) Foreign Application Priority Data

Jan. 6, 2014 (JP) ..... 2014-000600
Jan. 6, 2014 (JP) ..... 2014-000610
Jan. 6, 2014 (JP) ..... 2014-000611

(51) Int. Cl.
*G03G 21/16* (2006.01)
*G03G 21/18* (2006.01)

(52) U.S. Cl.
CPC ..... *G03G 21/1814* (2013.01); *G03G 21/1857* (2013.01); *G03G 21/1896* (2013.01)

(58) Field of Classification Search
CPC ..... G03G 21/1814; G03G 21/1853; G03G 15/757
(Continued)

(56) References Cited

U.S. PATENT DOCUMENTS 7,991,322 B2 * 8/2011 Ukai ..... 399/111
8,050,593 B2 11/2011 Furuichi et al.
(Continued)

FOREIGN PATENT DOCUMENTS

JP 2001-337578 A 12/2001
JP 2008-292769 A 12/2008
(Continued)

OTHER PUBLICATIONS

Feb. 7, 2017—(JP) Notification of Reasons for Refusal—App 2014-000600.

*Primary Examiner* — Hoang Ngo
(74) *Attorney, Agent, or Firm* — Banner & Witcoff, Ltd.

(57) ABSTRACT

A process cartridge comprises: a developing cartridge; and a photosensitive member cartridge receiving the developing cartridge. The photosensitive member cartridge comprises a photosensitive member, and a pressing member configured to press the developing cartridge. The developing cartridge is configured to be located at a first position at which it is pressed by the pressing member and at a second position at which it is separable from the photosensitive member cartridge. The developing cartridge comprises: a driving mechanism including a detected member, and a covering member configured to cover the driving mechanism. The covering member comprises: a receiving part protruding configured to receive at least a part of the detected member; and an abutting part continuing to the receiving part, the abutting part being configured to abut on a member in the image forming apparatus main body and to move the developing cartridge to the first position.

15 Claims, 20 Drawing Sheets

(58) Field of Classification Search
USPC ..... 399/111, 167
See application file for complete search history.

(56) References Cited

U.S. PATENT DOCUMENTS

| | | | |
|---|---|---|---|
| 8,644,730 | B2 | 2/2014 | Takagi |
| 2008/0292356 | A1 | 11/2008 | Furuichi et al. |
| 2011/0236060 | A1 | 9/2011 | Takagi |
| 2013/0051847 | A1 | 2/2013 | Kamimura |

FOREIGN PATENT DOCUMENTS

| | | | |
|---|---|---|---|
| JP | 2011-203365 | A | 10/2011 |
| JP | 2013-054052 | A | 3/2013 |

* cited by examiner 361
362
365
320
371
372
368
364
366
363
367
370
369
321
UPPER
RIGHT
REAR
FRONT
LEFT
LOWER

PROCESS CARTRIDGE AND PHOTOSENSITIVE MEMBER CARTRIDGE

CROSS REFERENCE TO RELATED APPLICATIONS

This application is based upon and claims the benefit of priorities of Japanese Patent Application No. 2014-000600 filed on Jan. 6, 2014, Japanese Patent Application No. 2014-000610 filed on Jan. 6, 2014 and Japanese Patent Application No. 2014-000611 filed on Jan. 6, 2014, the contents of which are incorporated herein by reference in its entirety.

BACKGROUND

The present invention relates to a process cartridge and a photosensitive member cartridge configured to be mounted to an electrophotographic image forming apparatus.

An image forming apparatus has been known in which a developing cartridge including a developing roller is mounted to a drum cartridge including a photosensitive drum, which are then detachably mounted to an apparatus main body of the image forming apparatus, as a process cartridge.

For example, the drum cartridge of the process cartridge includes a developing cartridge mounting part for mounting the developing cartridge and a lock member for suppressing separation of the mounted developing cartridge. When mounting the developing cartridge to the drum cartridge, the developing cartridge is first positioned above the drum cartridge. Then, the developing cartridge is moved downwards to mount the developing cartridge to the developing cartridge mounting part of the drum cartridge. At this time, the lock member is engaged to a boss of the developing cartridge from above, so that the separation of the developing cartridge from the drum cartridge is suppressed. Then, the process cartridge is mounted to a main body casing of a laser printer.

According to the related process cartridge, when mounting the developing cartridge to the drum cartridge, the developing cartridge may be imperfectly mounted to the developing cartridge mounting part of the drum cartridge. When the process cartridge is mounted to the main body casing at this state, an image forming operation cannot be performed.

SUMMARY

It is therefore an object of the present invention to provide a process cartridge capable of securely mounting a developing cartridge to a photosensitive member cartridge at a state where the process cartridge is mounted to a main body of an image forming apparatus, and a developing cartridge.

According to an aspect of the present disclosure, the following arrangements are provided:

A process cartridge comprising:

a developing cartridge configured to receive therein developer; and a photosensitive member cartridge configured to detachably receive therein the developing cartridge, the process cartridge being configured to be detachably mounted to an image forming apparatus main body, wherein the photosensitive member cartridge comprises:

a photosensitive member, and a pressing member configured to press the developing cartridge towards the photosensitive member, wherein the developing cartridge is configured to be located at a first position at which the developing cartridge is pressed by the pressing member and at a second position at which the developing cartridge is separable from the photosensitive member cartridge, wherein the developing cartridge comprises:

a driving mechanism including a detected member configured to be applied with a driving force from a driving source provided for the image forming apparatus main body, the detected member being configured to be rotated by the applied driving force and to be detected by a detection device provided for the image forming apparatus main body, and a covering member configured to cover the driving mechanism, and wherein the covering member comprises:

a base part extending in a direction orthogonal to a first direction in which a rotational axis line of the detected member extends;

a receiving part protruding from the base part in the first direction and configured to receive at least a part of the detected member; and an abutting part protruding from the base part in the first direction and continuing to the receiving part, the abutting part being configured to abut on a member in the image forming apparatus main body and to move the developing cartridge to the first position when the process cartridge is mounted to the image forming apparatus main body at a state where the developing cartridge is located at the second position.

A photosensitive member cartridge comprising:

a photosensitive member configured to rotate about a rotational axis line extending in a first direction, and a housing including a first receiving part configured to receive therein the photosensitive member and a second receiving part provided in the vicinity of the first receiving part in a second direction orthogonal to the first direction and configured to receive therein a developing cartridge including a developing roller, wherein the second receiving part comprises:

a first sidewall extending orthogonal to the first direction, a second sidewall arranged at an interval with the first sidewall in the first direction, a coupling wall configured to couple the first sidewall and the second sidewall, a first leg part protruding from the coupling wall, and a second leg part arranged at an interval with the first leg part in the first direction and protruding from the coupling wall, and wherein a tip of the second leg part is arranged at a different position from a tip of the first leg part in the second direction.

DESCRIPTION OF ILLUSTRATIVE EMBODIMENTS

First Embodiment

A first embodiment according to the present disclosure will be described hereinafter with reference to FIGS. 1 to 10.

1. Outline of Process Cartridge

Figure 1:
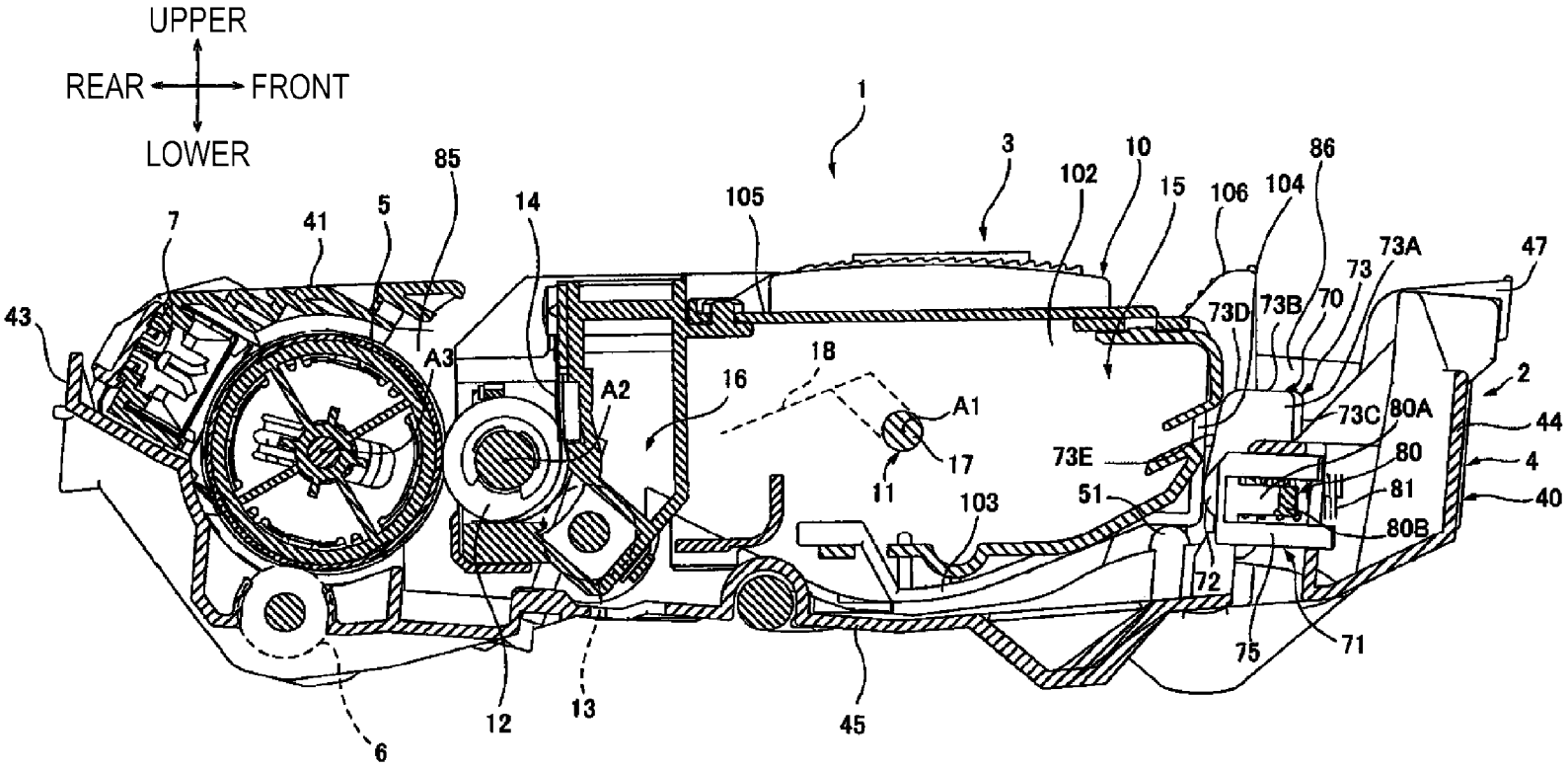
FIG. 1 is a side sectional view illustrating an illustrative embodiment of a process cartridge according to a first embodiment.

As shown in FIG. 1, a process cartridge 1 includes a drum cartridge 2, which is an example of the photosensitive member cartridge, and a developing cartridge 3.

Meanwhile, in below descriptions, the directions of the process cartridge 1 are described on the basis of a state where the process cartridge 1 is horizontally placed. That is, the upper side of the sheet of FIG. 1 is the upper side and the lower side of the sheet is the lower side. The right side of the sheet of FIG. 1 is the front side and the left side of the sheet of FIG. 1 is the rear side. The left and right sides are set on the basis of a state where the process cartridge 1 is seen from the front side. That is, the front side of the sheet of FIG. 1 is the left side and the inner side of the sheet is the right side. The left-right direction is an example of the third direction, the upper-lower direction is an example of the second direction and the front-rear direction is an example of the first direction.

The drum cartridge 2 includes a drum frame 4, which is an example of the second housing, a photosensitive drum 5, which is an example of the photosensitive member, a transfer roller 6 and a scorotron-type charger 7.

The drum frame 4 has a substantially rectangular bottomed frame shape extending in the left-right direction, as seen from above.

The photosensitive drum 5 is positioned at a rear end portion of the drum frame 4. The photosensitive drum 5 has a substantially cylindrical shape extending in the left-right direction. The photosensitive drum 5 is rotatably supported at both left and right end portions thereof to the drum frame 4, so that it can be rotated about a rotational axis line A3 extending in the left-right direction.

The transfer roller 6 is rotatably supported to a rear lower end portion of the drum frame 4. The transfer roller 6 is positioned below the photosensitive drum 5. The transfer roller 6 has a substantially cylindrical shape, and an upper end portion thereof is contacted to a lower end portion of the photosensitive drum 5.

The scorotron-type charger 7 is positioned at a rear-upper side of the photosensitive drum 5.

The developing cartridge 3 includes a developing frame 10, which is an example of the first housing, an agitator 11, which is an example of the agitation member, a developing roller 12, a supply roller 13 and a layer thickness regulation blade 14.

The developing frame 10 has a substantial box shape extending in the left-right direction. A rear end portion of the developing frame 10 is opened in the front-rear direction. The developing frame 10 includes therein a toner receiving chamber 15, which is an example of the developer receiving chamber, and a developing chamber 16. The toner receiving chamber 15 and the developing chamber 16 are provided in parallel in the front-rear direction. The toner is received in the toner receiving chamber 15.

The agitator 11 is positioned at a substantial central part of the toner receiving chamber 15 in the front-rear and upper-lower directions. The agitator 11 includes an agitator shaft 17, which is an example of the rotational shaft, and an agitation blade 18. The agitator shaft 17 has a substantially cylindrical shape extending in the left-right direction. The agitation blade 18 extends from the agitator shaft 17 towards a diametrically outer side of the agitator shaft 17. Both left and right end portions of the agitator shaft 17 are rotatably supported to the developing frame 10, so that the agitator 11 can be rotated about a rotational axis line A1 extending in the left-right direction, which is an example of the first rotational axis line.

The developing roller 12 is positioned at a rear end portion of the developing chamber 16. The developing roller 12 has a substantially cylindrical shape extending in the left-right direction. Both left and right end portions of the developing roller 12 are rotatably supported to the developing frame 10, so that the developing roller 12 can be rotated about a rotational axis line A2 extending in the left-right direction, which is an example of the second rotational axis line. A rear part of the developing roller 12 is exposed from the developing frame 10. A rear end portion of the developing roller 12 is contacted to a front lower end portion of the photosensitive drum 5.

The supply roller 13 is positioned at a front-lower side of the developing roller 12 in the developing chamber 16. The supply roller 13 has substantially cylindrical shape extending in the left-right direction. Both left and right end portions of the supply roller 13 are rotatably supported to the developing frame 10, so that the supply roller 13 can be rotated about an axis line extending in the left-right direction. A rear upper end portion of the supply roller 13 is contacted to a front lower end portion of the developing roller 12.

The layer thickness regulation blade 14 extends in the upper-lower direction in front of the developing roller 12, and a lower end portion thereof is contacted to a front end portion of the developing roller 12.

2. Using Aspect of Process Cartridge

Figure 2:
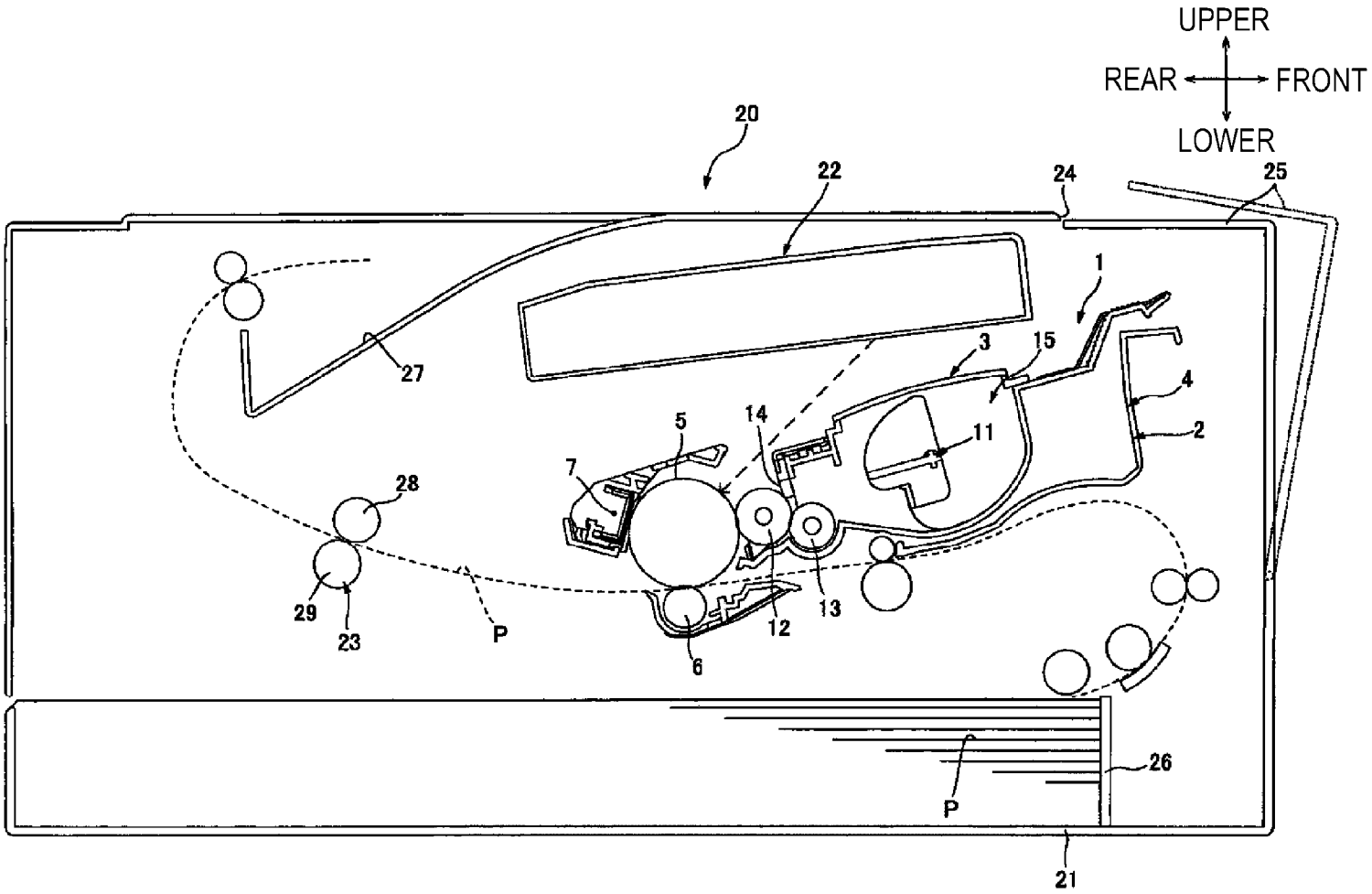
FIG. 2 is a central sectional view of a printer including the process cartridge shown in FIG. 1.

As shown in FIG. 2, the process cartridge 1 is used with being mounted to an image forming apparatus 20.

The image forming apparatus 20 is an electrophotographic monochrome printer. The image forming apparatus 20 includes an apparatus main body 21, which is an example of the image forming apparatus main body, the process cartridge 1, a scanner unit 22 and a fixing unit 23.

The apparatus main body 21 has a substantial box shape. The apparatus main body 21 includes an opening 24, a front cover 25, a sheet feeding tray 26 and a sheet discharge tray 27.

The opening 24 is opened at a front wall of the apparatus main body 21. The opening 24 is configured to communicate the inside and outside of the apparatus main body 21 in the front-rear direction so that the process cartridge 1 can pass therethrough.

The front cover 25 is positioned at a front end portion of the apparatus main body 21. The front cover 25 has a substantially flat plate shape. The front cover 25 extends in the upper-lower direction and is swingably supported to the front wall of the apparatus main body 21 at a lower end portion thereof serving as a support point. The front cover 25 is configured to open or close the opening 24.

The sheet feeding tray 26 is positioned at a bottom of the apparatus main body 21. The sheet feeding tray 26 is configured to receive therein sheets P.

The sheet discharge tray 27 is positioned at a rear half part of an upper wall of the apparatus main body 21. The sheet discharge tray 27 is formed to have a recess shape downwardly from an upper surface of the apparatus main body 21 so that the sheets P can be placed thereon.

The process cartridge 1 is received at a substantial center of the apparatus main body 21 in the upper-lower direction. The process cartridge 1 is configured to be mounted or demounted to or from the apparatus main body 21.

The scanner unit 22 is arranged above the process cartridge 1. The scanner unit 22 is configured to emit a laser beam based on image data towards the photosensitive drum 5.

The fixing unit 23 is arranged at the rear of the process cartridge 1. The fixing unit 23 includes a heating roller 28 and a pressing roller 29 pressure-contacted to a rear lower end portion of the heating roller 28.

When the image forming apparatus 20 starts an image forming operation, the scorotron-type charger 7 uniformly charges a surface of the photosensitive drum 5.

The scanner unit 22 exposes the surface of the photosensitive drum 5 on the basis of the image data. Thereby, an electrostatic latent image based on the image data is formed on the surface of the photosensitive drum 5.

The agitator 11 agitates the toner in the toner receiving chamber 15, thereby supplying the same to the supply roller 13. The supply roller 13 supplies the toner supplied by the agitator 11 to the developing roller 12. At this time, the toner is carried on the developing roller 12 with being positively friction-charged between the developing roller 12 and the supply roller 13. The layer thickness regulation blade 14 regulates a layer thickness of the toner carried on the developing roller 12 to a predetermined thickness.

The toner carried on the developing roller 12 is supplied to the electrostatic latent image on the surface of the photosensitive drum 5. Thereby, a toner image is carried on the surface of the photosensitive drum 5.

The sheet P is fed one by one at predetermined timing from the sheet feeding tray 26 towards between the photosensitive drum 5 and the transfer roller 6 by rotations of various rollers. The toner image on the surface of the photosensitive drum 5 is transferred to the sheet P while the sheet P passes between the photosensitive drum 5 and the transfer roller 6.

After that, the sheet P is heated and pressed while it passes between the heating roller 28 and the pressing roller 29. Thereby, the toner image on the sheet P is heat-fixed on the sheet P. Thereafter, the sheet P is discharged to the sheet discharge tray 27.

3. Details of Process Cartridge

Figure 3:
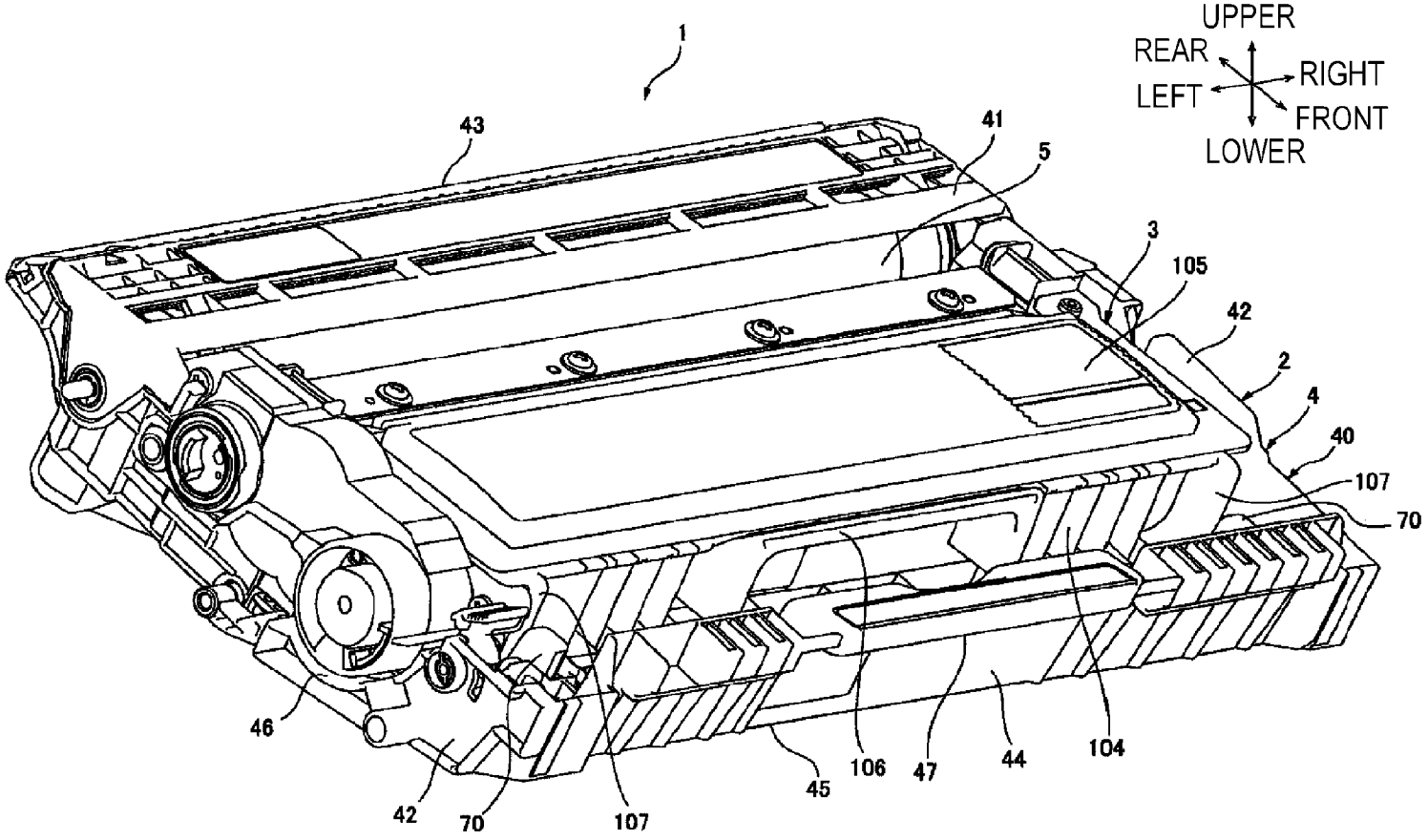
FIG. 3 is a perspective view of the process cartridge shown in FIG. 1, as seen from the left-upper side.
Figure 4:
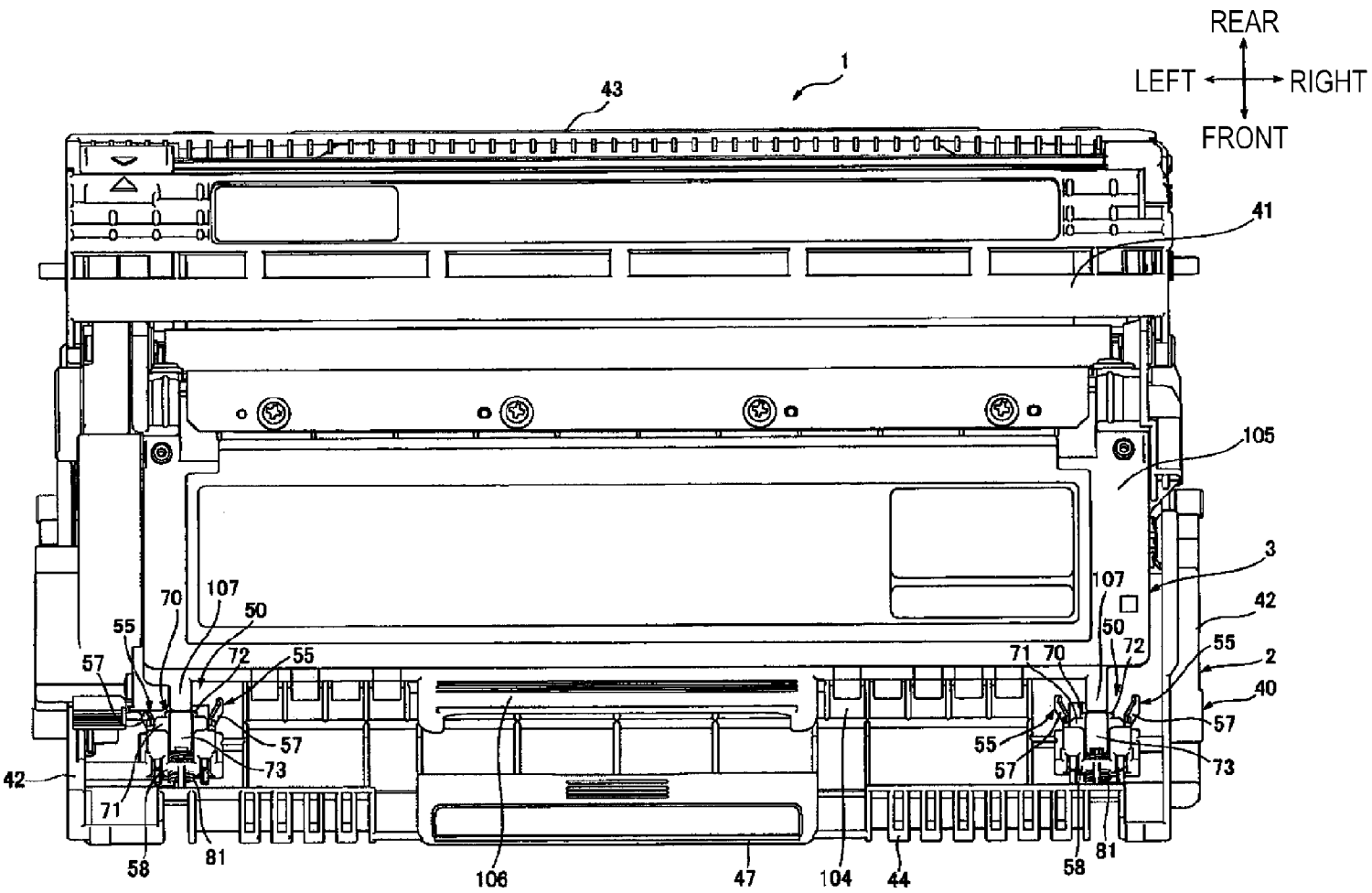
FIG. 4 is a plan view of the process cartridge shown in FIG. 1.

As shown in FIGS. 3 and 4, the process cartridge 1 includes the drum cartridge 2 and the developing cartridge 3.

(1) Drum Cartridge

The drum cartridge 2 includes a base frame 40 and a cover frame 41.

(1-1) Base Frame

The base frame 40 has a substantially rectangular bottomed frame shape, as seen from above. The base frame 40 integrally includes a pair of sidewalls 42, a rear wall 43, a front wall 44 and a lower wall 45.

The pair of sidewalls 42 is positioned at both left and right end portions of the base frame 40, respectively. Each of the pair of sidewalls 42 has a substantially rectangular flat plate shape, as seen from the side. Each of the pair of sidewalls 42 extends in the front-rear direction. A front end portion of the left sidewall 42 is provided with an receiving part 46 having a substantially semi-circular shape of which an upper end portion is opened, as seen from the side.

The rear wall 43 is bridged between rear end portions of the pair of sidewalls 42. The rear wall 43 has a substantially rectangular flat plate shape, as seen from the front, and extends in the left-right direction.

The front wall 44 is bridged between front end portions of the pair of sidewalls 42. The front wall 44 has a substantially rectangular flat plate shape, as seen from the front, and extends in the left-right direction. The front wall 44 includes a drum cartridge gripping part 47.

The drum cartridge gripping part 47 is positioned at a substantial center of the front wall 44 in the left-right direction. The drum cartridge gripping part 47 has a substantially rectangular flat plate shape, as seen from above. The drum cartridge gripping part 47 extends forwards from an upper end portion of the front wall 44.

The lower wall 45 is bridged among lower end portions of the pair of sidewalls 42, a lower end portion of the rear wall 43 and a lower end portion of the front wall 44. The lower wall 45 has a substantially rectangular flat plate shape, as seen from above, and extends in the left-right direction. The lower wall 45 includes two support parts 50 and two abutting convex part 51.

(1-2) Support Part and Abutting Convex Part

Figure 5:
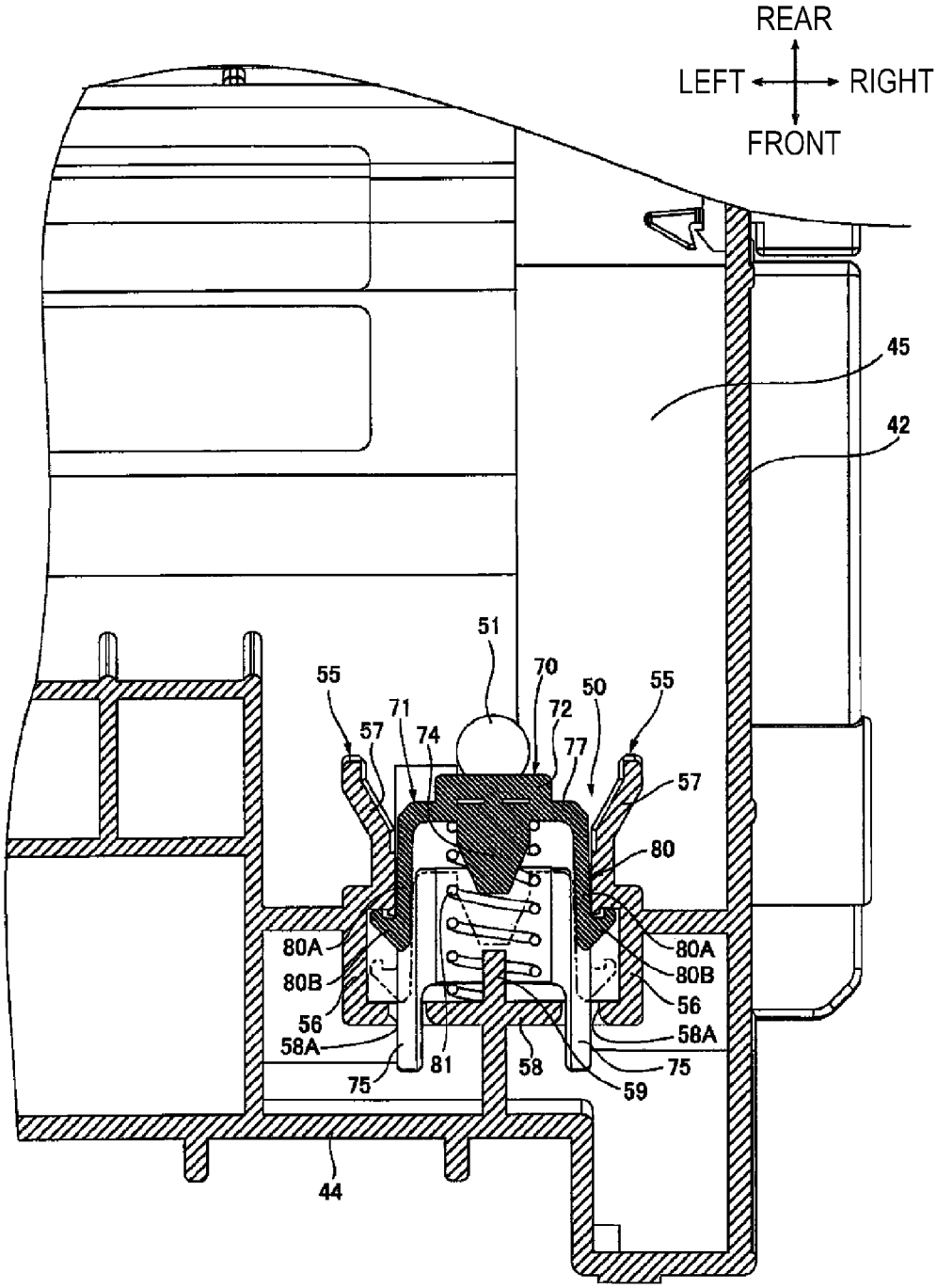
FIG. 5 is a top sectional view illustrating an engaged state of a pressing member to a housing in a drum cartridge shown in FIG. 3.

As shown in FIGS. 4 and 5, the two support parts 50 are positioned at both left and right end portions of the lower wall 45, respectively, and are integrally provided for the lower wall 45. Each of the two support parts 50 has a substantial U shape of which a rear side is opened, as seen from above, and protrudes upwards from an upper surface of the lower wall 45. Each of the two support parts 50 includes a pair of side plates 55 and a front plate 58.

As shown in FIG. 5, the pair of side plates 55 extends in the front-rear direction at an interval with each other in the left-right direction, respectively. Each of the pair of side plates 55 includes a front side plate part 56 and a rear side plate part 57.

The pair of front side plate parts 56 is positioned at a front part of the support part 50, respectively. Each of the pair of front side plate parts 56 has a substantially rectangular shape, as seen from the side, and extends rearwards from the rear of the front wall 44 of the drum cartridge 2, as seen from above. The pair of front side plate parts 56 is positioned at an interval in the left-right direction.

The pair of rear side plate parts 57 is positioned at a rear part of the support part 50, respectively. Each of the pair of rear side plate parts 57 has a substantially rectangular shape, as seen from the side, and extends rearwards from a rear end portion of each of the pair of front side plate parts 56, as seen from above. Specifically, each of the pair of rear side plate parts 57 protrudes inwards in the left-right direction from the rear end portion of each of the front side plate parts 56, then extends rearwards and is then inclined outwards in the left-right direction as it faces rearwards.

The front plate 58 extends in the left-right direction between front end portions of the pair of front side plate parts 56. An engaging protrusion 59 protrudes rearwards from a central part of the front plate 58 in the left-right direction. The engaging protrusion 59 is configured to restrain a compression spring 81 (which will be described later) from moving in the left-right direction. A guide hole 58A penetrating the front plate 58 in the front-rear direction is respectively positioned at both left and right end portions of the front plate 58.

Each of the two abutting convex parts 51 is positioned at the rear of each of the two support parts 50. Each of the two abutting convex parts 51 is integrally provided for the lower wall 45. Each of the two abutting convex parts 51 has a substantially semi-spherical shape and is bulged upwards from an upper surface of the lower wall 45.

Each of the two support parts 50 is attached with a pressing member 70.

(1-3) Pressing Member

Figure 6A:
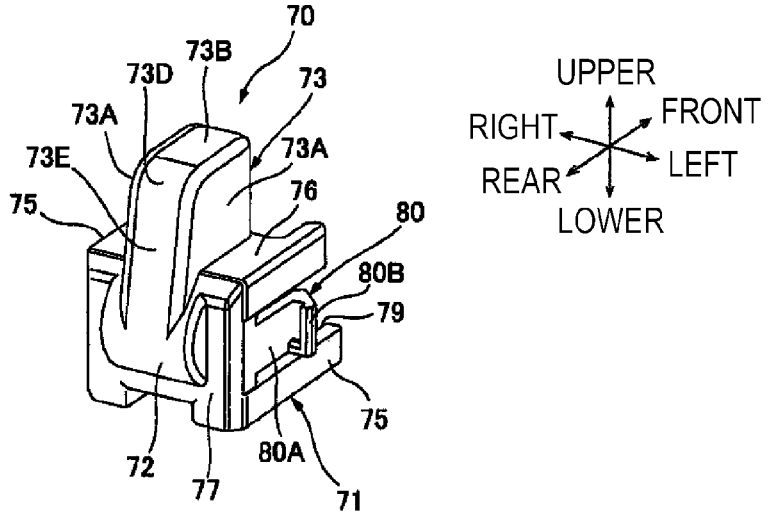
FIG. 6A is a perspective view of the pressing member shown in FIG. 3, as seen from the left-upper side.

As shown in FIG. 5, each of the two pressing members 70 is positioned between the pair of side plates 55 of each of the two support parts 50. Each of the two pressing members 70 has a substantially cylindrical shape extending in the front-rear direction and is closed at a rear side thereof. As shown in FIGS. 5 and 6A, each of the two pressing members 70 includes a main body part 71, a pressing part 72, a protrusion part 73 and a spring attaching part 74.

Figure 6B:
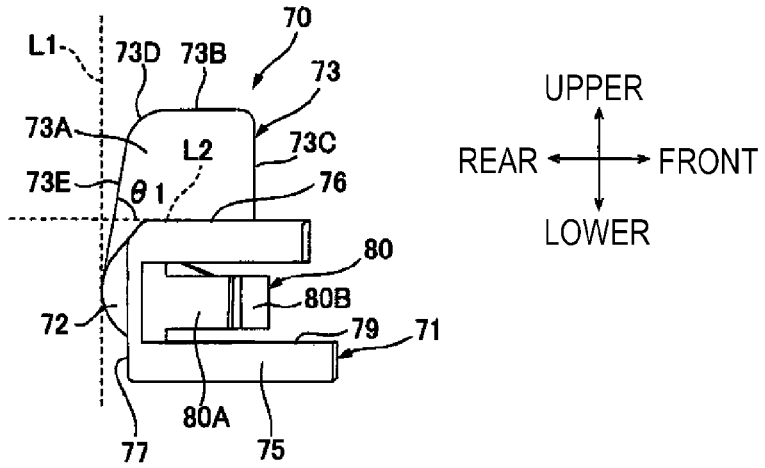
FIG. 6B is a left side view of the pressing member shown in FIG. 3.

As shown in FIGS. 6A and 6B, the main body part 71 has a substantially cylindrical shape extending in the front-rear direction. The main body part 71 includes an opened lower side and a closed rear side. The main body part 71 includes a pair of main body sidewalls 75, a main body upper wall 76 and a main body rear wall 77.

The pair of main body sidewalls 75 has a substantially rectangular plate shape extending in the front-rear direction, respectively, as seen from the side. The pair of main body sidewalls 75 is spaced at an interval in the left-right direction. Each of the main body sidewalls 75 includes a notched part 79 and an engaging part 80.

Each of the pair of notched parts 79 has a substantially rectangular shape, as seen from the side, and is formed by notching each of the main body sidewalls 75 forwards from a rear end portion thereof. Thereby, each of the pair of main body sidewalls 75 is configured by an upper end part and a lower end part with the notched part 79 being positioned therebetween, at a region except for the rear end portion. As shown in FIG. 5, each of the pair of main body sidewalls 75 is inserted into the guide hole 58A of the support part 50. As shown in FIGS. 6A and 6B, the engaging part 80 is positioned between the upper end part and the lower end part of each of the pair of main body sidewalls 75.

Each of the pair of engaging parts 80 extends in the front-rear direction between the upper end part and the lower end part of each of the pair of main body sidewalls 75. Each of the pair of engaging parts 80 includes an engaging base end portion 80A and an engaging protrusion 80B. Each of the pair of engaging base end portions 80A has a substantially rectangular plate shape extending in the front-rear direction, as seen from the side, and extends forwards from a rear end portion of the main body sidewall 75 at each of the pair of notched parts 79. Each of the pair of engaging protrusions 80B is positioned at a front end portion of each of the pair of engaging base end portions 80A. Each of the pair of engaging protrusions 80B protrudes outwards in the left-right direction in a substantial hook shape. As shown in FIG. 5, each of the pair of engaging protrusion 80B is positioned in front of each of the pair of rear side plate parts 57 of the support part 50.

As shown in FIGS. 6A and 6B, the main body upper wall 76 is bridged between upper end portions of the pair of main body sidewalls 75. The main body upper wall 76 has a substantially rectangular plate shape extending in the front-rear direction, as seen from above.

The main body rear wall 77 is bridged between the rear end portions of the pair of main body sidewalls 75 and the rear end portion of the main body upper wall 76.

The pressing part 72 protrudes so that it is curved rearwards from the main body rear wall 77 of the main body part 71. The pressing part 72 has a substantial arc shape, as seen from the side. The pressing part 72 is positioned at a substantially central part of the main body rear wall 77 of the main body part 71, as seen from the back.

The protrusion part 73 protrudes upwards from the main body upper wall 76 of the main body part 71 and also protrudes rearwards from the main body rear wall 77 of the main body part 71. The protrusion part 73 has a substantially trapezoidal plate shape having a predetermined thickness in the left-right direction, as seen from the side. The protrusion part 73 includes a pair of protrusion side surfaces 73A, a protrusion upper surface 73B, a protrusion front surface 73C, a guide surface 73E and a curved surface 73D.

The pair of protrusion side surfaces 73A configures both left and right side surfaces of the protrusion part 73. Each of the pair of protrusion side surfaces 73A has a substantially trapezoidal shape, as seen from the side, and extends upwards from the main body upper wall 76 of the main body part 71 and also extends rearwards from the main body rear wall 77 of the main body part 71.

The protrusion upper surface 73B configures an upper surface of the protrusion part 73. The protrusion upper surface 73B has a substantially rectangular shape extending in the front-rear direction, as seen from above, and continues to an upper end of each of the pair of protrusion side surfaces 73A.

The protrusion front surface 73C configures a front surface of the protrusion part 73. The protrusion front surface 73C has a substantially rectangular shape extending in the upper-lower direction, as seen from the front, and continues to a front end of each of the pair of protrusion side surfaces 73A and a front end of the protrusion upper surface 73B.

The guide surface 73E configures a rear surface of the protrusion part 73. The guide surface 73E is positioned at the rear at an interval with the protrusion front surface 73C and is also positioned at a rear-lower side of the protrusion upper surface 73B. The guide surface 73E has a substantially rectangular shape extending in a direction facing from the front-upper side towards the rear-lower side, as seen from the back, and a lower end portion thereof continues to a central part of the pressing part 72. The guide surface 73E is inclined forwards with respect to a virtual line L1 passing through the central part of the pressing part 72 and extending in the upper-lower direction. In other words, as shown in FIG. 1, the guide surface 73E faces the photosensitive drum 5 and is inclined to be more spaced from the photosensitive drum 5 as it protrudes upwards. Specifically, as shown in FIG. 6B, an angle θ1 between a virtual line L2 extending in the front-rear direction and the guide surface 73E, as seen from the side, is 45° or greater and less than 90°, preferably 65° or greater and 85° or less. Specifically, the angle θ1 is 80°. When projected in the upper-lower direction, a lower part of the guide surface 73E overlaps with the pressing part 72.

As shown in FIGS. 6A and 6B, the curved surface 73D configures a rear upper surface of the protrusion part 73. The curved surface 73D is positioned between the protrusion upper surface 73B and the guide surface 73E. The curved surface 73D has a substantial arc shape curved in a rear-upper direction, as seen from the side. An upper end of the curved surface 73D continues to a rear end of the protrusion upper surface 73B, and a lower end of the curved surface 73D continues to an upper end of the guide surface 73E. The curved surface 73D is positioned at an opposite side to the main body part 71, as seen from the side.

The spring attaching part 74 extends forwards from a front surface of the main body rear wall 77 of the main body part 71. The spring attaching part 74 has a substantially cylindrical shape and is tapered forwards. The compression spring 81 is attached to the spring attaching part 74.

The compression spring 81 is a coil spring configured by winding a wire rod and extends in the front-rear direction. A rear end portion of the compression spring 81 is fitted to an outer periphery of the spring attaching part 74 of the pressing member 70. A front end portion of the compression spring 81 is fitted to the engaging protrusion 59 and abuts on a rear surface of the front plate 58. The compression spring 81 is positioned with being compressed between the spring attaching part 74 of the pressing member 70 and the front plate 58. Thereby, the compression spring 81 is configured to always urge the pressing member 70 rearwards.

Each of the pressing members 70 can be slid in the front-rear direction between a front position shown with a virtual line in FIG. 5 and a rear position shown with a solid line. When each of the pressing members 70 is located at the rear position, the engaging protrusion 80B is engaged with the rear side plate part 57, so that it is restrained from further moving rearwards.

(1-4) Cover Frame

As shown in FIGS. 1 and 3, the cover fame 41 is positioned above the rear end portion of the base frame 40. The cover fame 41 has a substantially rectangular flat plate shape, as seen from above, and extends in the left-right direction. A space surrounded by the cover fame 41, the rear end portions of the pair of sidewalls 42, the rear wall 43 and the rear end portion of the lower wall 45 is a drum receiving part 85. The photosensitive drum 5 is received at a central part of the drum receiving part 85, as seen from the side, the scorotron-type charger 7 is received at a rear-upper part of the drum receiving part 85 and the transfer roller 6 is received at a lower part of the drum receiving part 85. A space surrounded by the pair of sidewalls 42, the front wall 44 and the lower wall 45 in front of the drum receiving part 85 is a cartridge receiving part 86. The developing cartridge 3 is received in the cartridge receiving part 86.

(2) Developing Cartridge

Figure 7:
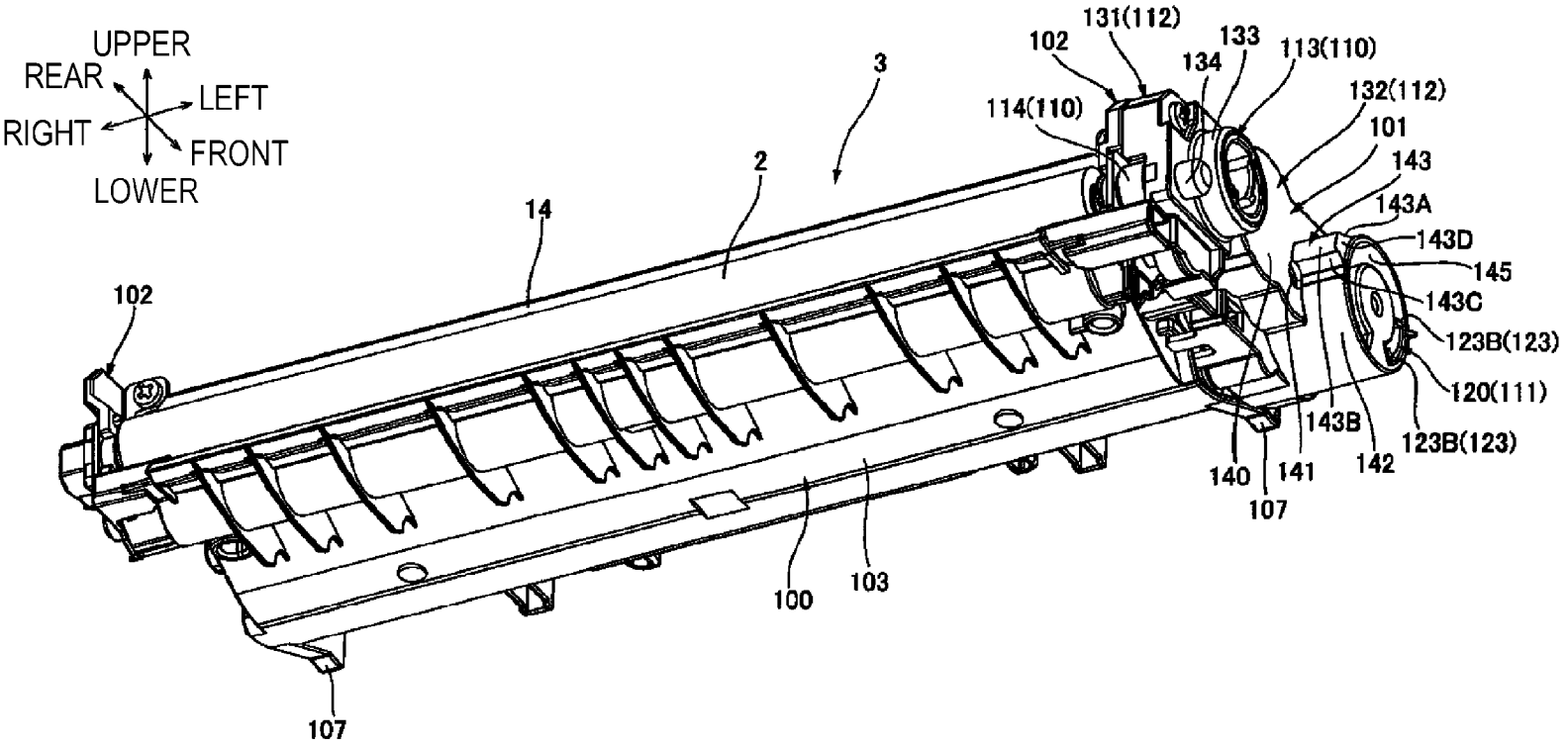
FIG. 7 is a perspective view of the developing cartridge shown in FIG. 3, as seen from the left-lower side.
Figure 8A:
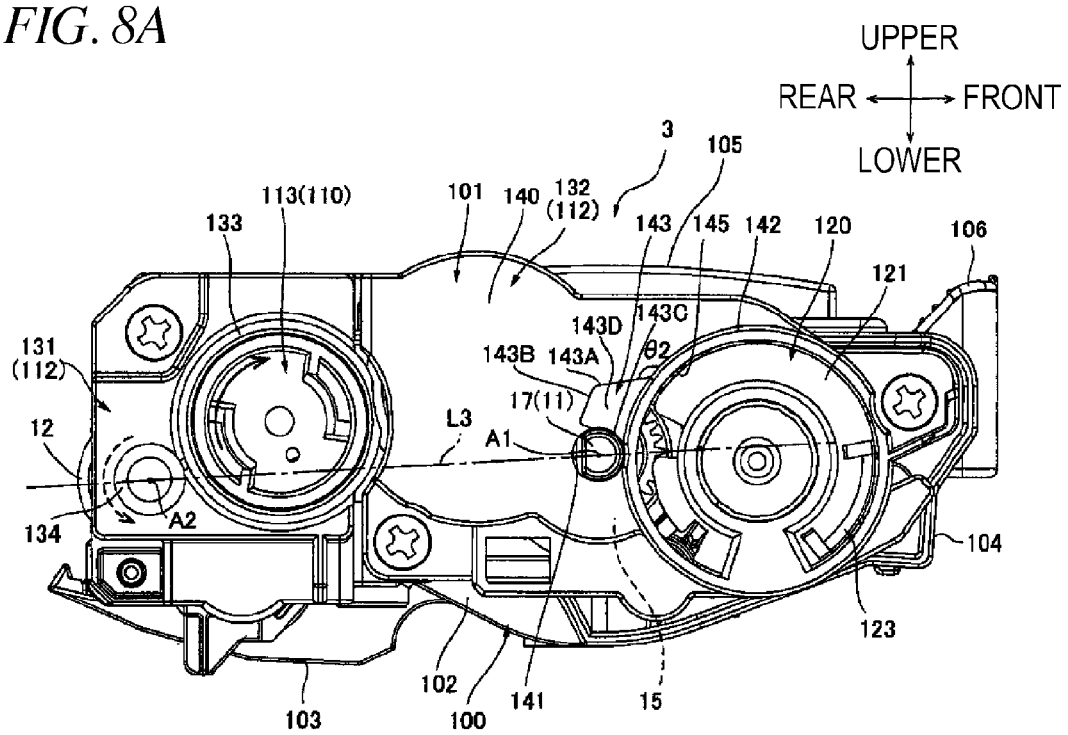
FIG. 8A is a left side view of the developing cartridge shown in FIG. 3.

As shown in FIGS. 7 and 8A, the developing cartridge 3 includes a developing frame 100 and a driving unit 101.

(2-1) Developing Frame

The developing frame 100 has a substantial box shape. The developing frame 100 includes a pair of sidewalls 102, a lower wall 103, a front wall 104 and an upper wall 105.

The pair of sidewalls 102 is respectively positioned at both left and right end portions of the developing frame 100. Each of the pair of sidewalls 102 has a substantially rectangular flat plate shape extending in the front-rear and upper-lower directions, as seen from the side. As shown in FIG. 7, each of the pair of sidewalls 102 includes an extension part 107. The extension part 107 is positioned at a front end portion of each of the pair of sidewalls 102. The extension part 107 has a substantially rectangular flat plate shape, as seen from the side. The extension part 107 extends forwards from a front end portion of each of the pair of sidewalls 102. A size of the extension part 107 in the left-right direction is substantially the same as a size of the protrusion part 73 of the pressing member 70 in the left-right direction.

As shown in FIGS. 7 and 8A, the lower wall 103 has a substantially flat plate shape extending in the front-rear and left-right directions. Both left and right end portions of the lower wall 103 continue to lower end portions of the pair of sidewalls 102.

The front wall 104 has a substantially flat plate shape extending in the upper-lower and left-right directions. A lower end portion of the front wall 104 continues to a front end portion of the lower wall 103. Both left and right end portions of the front wall 104 continue to the front end portions of the pair of sidewalls 102, respectively. As shown in FIGS. 3 and 4, the front wall 104 includes a developing gripping part 106.

The developing gripping part 106 is positioned at a substantial center of the front wall 104 in the left-right direction. The developing gripping part 106 has a substantially rectangular shape, as seen from above. The developing gripping part 106 protrudes forwards and upwards from the substantial center of the front wall 104 in the left-right direction. The developing gripping part 106 is positioned at the rear of the drum cartridge gripping part 47 at an interval with the drum cartridge gripping part 47 of the drum cartridge 2 with the developing cartridge 3 being received in the cartridge receiving part 86 of the drum cartridge 2.

The upper wall 105 has a substantially flat plate shape extending in the front-rear and left-right directions. A front end portion of the upper wall 105 continues to an upper end portion of the front wall 104. Both left and right end portions of the upper wall 105 continue to upper end portions of the pair of sidewalls 102, respectively.

The pair of sidewalls 102, the lower wall 103 and the front wall 104 configure an example of the first frame, and the upper wall 105 configures an example of the second frame. That is, the upper wall 105 is positioned above the pair of sidewalls 102, the lower wall 103 and the front wall 104 and is joined thereto.

(2-2) Driving Unit

As shown in FIGS. 7 and 8A, the driving unit 101 is positioned at the left side of the developing frame 100 at the left end portion of the developing cartridge 3. The driving unit 101 includes a gear train 110, a detection gear 120, which is an example of the detected member, and a gear cover 112, which is an example of the covering member. The gear train 110 and the detection gear 120 configure a driving mechanism.

(2-2-1) Gear Train

Figure 8B:
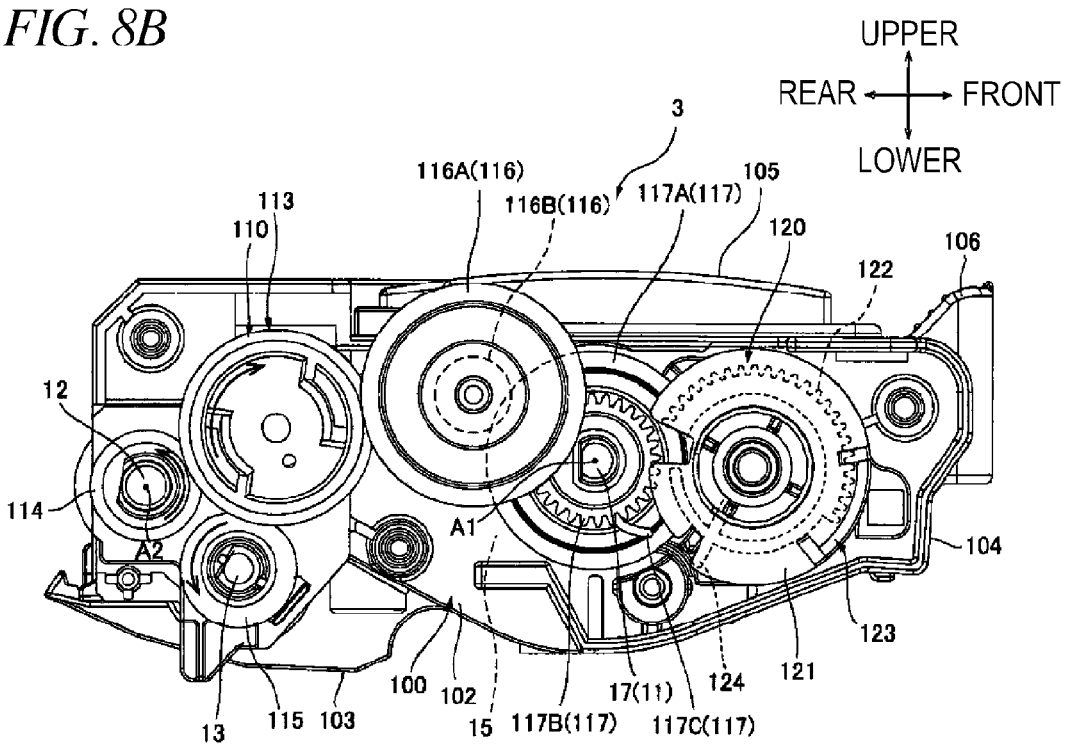
FIG. 8B is a left side view illustrating a state where a gear cover is detached from the developing cartridge shown in FIG. 3.

As shown in FIG. 8B, the gear train 110 includes a developing coupling 113, which is an example of the force-receiving member, a developing gear 114, a supply gear 115, an idle gear 116 and an agitator gear 117.

The developing coupling 113 is positioned at the rear end portion of the developing cartridge 3. The developing coupling 113 has a substantially cylindrical shape extending in the left-right direction. The developing coupling 113 includes gear teeth over an entire periphery thereof.

The developing gear 114 is positioned at a rear-lower side of the developing coupling 113. A left end portion of a shaft of the supply roller 13 protrudes from the left sidewall 102, and the developing gear 114 is supported to the left end portion of the shaft of the developing roller 12 so that it cannot be relatively rotated. The developing roller 114 is meshed with the developing coupling 113.

The supply gear 115 is positioned below the developing coupling 113. A left end portion of a shaft of the supply roller 3 protrudes from the left sidewall 102, and the supply gear 115 is supported to the left end portion of the shaft of the supply roller 13 so that it cannot be relatively rotated. The supply gear 115 is meshed with the developing coupling 113.

The idle gear 116 is positioned in front of the developing coupling 113. The idle gear 116 is rotatably supported to the left sidewall 102. The idle gear 116 integrally includes a large diameter gear 116A and a small diameter gear 116B positioned at the right side of the large diameter gear 116A. The large diameter gear 116A is meshed with the developing coupling 113.

The agitator gear 117 is positioned at a front-lower side of the idle gear 116. The agitator gear 117 includes a first gear part 117A, a second gear part 117B and an abutting rib 117C.

The first gear part 117A is meshed with a front end portion of the small diameter gear 116B of the idle gear 116.

The second gear part 117B is positioned in close to the left of the first gear part 117A. The second gear part 117B is configured to share a central axis line with the first gear part 117A. An outer diameter of the second gear part 117B is smaller than an outer diameter of the first gear part 117A.

The abutting rib 117C protrudes leftwards from a left surface of the first gear part 117A.

The agitator gear 117 is fitted to a left end portion of the agitator shaft 17 so that it cannot be relatively rotated.

(2-2-2) Detection Gear

The detection gear 120 has a substantially cylindrical shape extending in the left-right direction. The detection gear 120 is rotatably supported to the left sidewall 102. The detection gear 120 includes a main body part 121, a gear part 122 and a detection part 123.

The main body part 121 has a substantial disc plate shape having a thickness in the left-right direction. A slide part 124 protrudes rightwards from a right surface of the main body part 121. The slide part 124 has a substantially flat plate shape extending in a diametrical direction of the main body part 121.

The gear part 122 has a partially cylindrical shape extending rightwards from the right surface of the main body part 121 and including one opened diametrical end portion.

The detection part 123 protrudes leftwards from a left surface of the main body part 121. A position of an outer end portion of the detection part 123 in the left-right direction is substantially the same as a position of an outer edge portion of an receiving part 142, which will be described later.

(2-3) Gear Cover

The gear cover 112 includes a first cover 131 and a second cover 132.

The first cover 131 is positioned at a rear end portion of the driving unit 101. The first cover 131 has a substantial square tube shape extending in the left-right direction and including a closed left end portion. The first cover 131 is configured to cover the gear teeth of the developing coupling 113, the developing gear 114 and the supply gear 115. The first cover 131 includes a coupling collar 133 and a developing roller collar 134.

The coupling collar 133 is positioned at the center of the first cover 131. The coupling collar 133 has a substantially cylindrical shape extending in the left-right direction. The first cover 131 is formed with an opening corresponding to the coupling collar 133, so that the coupling collar 133 passes through the first cover 131 in the left-right direction. An inner diameter of the coupling collar 133 is substantially the same as an outer diameter of the developing coupling 113. The coupling collar 133 is fitted to the developing coupling 113.

The developing roller collar 134 is positioned at a rear-lower side of the coupling collar 133. The developing roller collar 134 has a substantially cylindrical shape extending in the left-right direction and including a closed left end portion. The first cover 131 is formed with an opening corresponding to the developing roller collar 134, so that the developing roller collar 134 passes through the first cover 131 in the left-right direction. The developing roller collar 134 is fitted to a left end portion of a shaft of the developing roller 12.

The second cover 132 is positioned in front of the first cover 131. The second cover 132 is configured to cover the idle gar 116, the agitator gear 117 and the detection gear 120. The second cover 132 includes a base part 140, the receiving part 142, a through-hole 141, which is an example of the opening, and an abutting part 143.

The base part 140 has a substantial square tube shape extending in the left-right direction and including a closed left end portion. A left wall of the base part 140 is orthogonal to the left-right direction.

The receiving part 142 is positioned at a front end portion of the second cover 132. The receiving part 142 has a substantially cylindrical shape extending leftwards from a left surface of the base part 140 and including a closed left end portion. A right end portion of the receiving part 142 is configured to communicate with an inside of a front end portion of the base part 140. The receiving part 142 is configured to receive therein the main body part 121 and detection part 123 of the detection gear 120. The receiving part 142 includes an exposed hole 145.

The exposed hole 145 has a substantial C shape, as seen from the side along a peripheral part of a left wall of the receiving part 142. The exposed hole 145 is formed to penetrate the left wall of the receiving part 142 in the left-right direction. The exposed hole 145 is configured to receive therein the detection part 123 of the detection gear 120.

The through-hole 141 is positioned at a substantial center of the second cover 132 in the front-rear direction, in the vicinity of the rear of the receiving part 142. The through-hole 141 has a substantially circular shape, as seen from the side. The through-hole 141 is formed to penetrate the left wall of the base part 140 in the left-right direction. When projected in the left-right direction, the through-hole 141 overlaps with the agitator shaft 17 fitted to the agitator gear 117.

The abutting part 143 is positioned at a substantial center of the second cover 132 in the front-rear direction, in the vicinity of the rear of the receiving part 142 and in the vicinity of the upper of the through-hole 141. The abutting part 143 has a substantial square column shape protruding from leftwards from the left surface of the base part 140, as seen from the side. A front end portion of the abutting part 143 continues to a rear end portion of the receiving part 142. The abutting part 143 includes an abutting surface 143A, a first reinforcement surface 143B, a second reinforcement surface 143C and a coupling surface 143D.

The abutting surface 143A configures an upper surface of the abutting part 143 and has a substantially rectangular shape extending in the left-right direction, as seen from above. The abutting surface 143A extends in a direction facing from the front-upper side towards the rear-lower side, as seen from the side. A front end of the abutting surface 143A continues to a rear upper end of the receiving part 142. As seen from the side, an angle θ2 between the abutting surface 143A and an outer peripheral edge of the receiving part 142 is obtuse. In the meantime, the angle θ2 is an angle between the abutting surface 143A and a tangential line of the outer peripheral edge of the receiving part 142 at a contact point of the abutting surface 143A and the receiving part 142. Specifically, the angle θ2 is 135°.

The first reinforcement surface 143B configures a rear surface of the abutting part 143, and has a substantially rectangular shape extending in the left-right direction, as seen from the front. The first reinforcement surface 143B extends in a direction facing from the front-upper side towards the rear-lower side, as seen from the side. An upper end of the first reinforcement surface 143B continues to a rear end of the abutting surface 143A.

The second reinforcement surface 143C configures a lower surface of the abutting part 143, and has a substantially rectangular shape extending in the left-right direction, as seen from the back. The second reinforcement surface 143C extends in a direction facing from the rear-upper side towards the front-lower side, as seen from the side. A rear end of the second reinforcement surface 143C continues to a lower end of the first reinforcement surface 143B, and a front end of the second reinforcement surface 143C continues to a rear end of the receiving part 142. Specifically, the second reinforcement surface 143C extends from the lower end of the first reinforcement surface 143B towards the front-lower side, then extends towards the front-lower side with being curved towards the front-upper side and continues to the receiving part 142, as seen from the side, and is configured to couple the first reinforcement surface 143B and the receiving part 142. The second reinforcement surface 143C coincides with an upper peripheral edge portion of the through-hole 141, as seen from the side. That is, the second reinforcement surface 143C is formed along the upper peripheral edge portion of the through-hole 141.

The coupling surface 143D configures a left surface of the abutting part 143. The coupling surface 143D has a substantially rectangular shape, as seen from the side, and continues to a left end of the abutting surface 143A, a left end of the first reinforcement surface 143B, a left end of the second reinforcement surface 143C and a left end of the rear end portion of the receiving part 142. In other words, the coupling surface 143D is configured to couple the left edge portions of the abutting surface 143A, the first reinforcement surface 143B and the second reinforcement surface 143C. The coupling surface 143D is substantially flush with an outer edge portion of the receiving part 142 in the left-right direction.

As shown in FIG. 7, a left end portion of the abutting part 143 is positioned at the left side of a left end portion of the developing coupling 113. As shown in FIG. 8A, the abutting part 143 is positioned above the rotational axis line A1 of the agitator 11. The abutting part 143 is positioned above a virtual line L3 connecting the rotational axis line A1 of the agitator 11 and the rotational axis line A2 of the developing roller 12. The abutting part 143 is located at a position at which it overlaps with the toner receiving chamber 15 in the left-right direction.

4. Mounting of Developing Cartridge to Drum Cartridge

When shipping the developing cartridge 3, an operator sees the agitator shaft 17 of the agitator 11 through the through-hole 141 and then checks a phase of the agitator 11, i.e., a position of the agitation blade 18 of the agitator 11, as shown in FIG. 8A. Then, the operator arranges the agitation blade 18 at a position at which it is not contacted to the inner periphery of the developing frame 10. After that, the operator mounts the developing cartridge 3 to the drum cartridge 2 at the corresponding state.

Figure 9A:
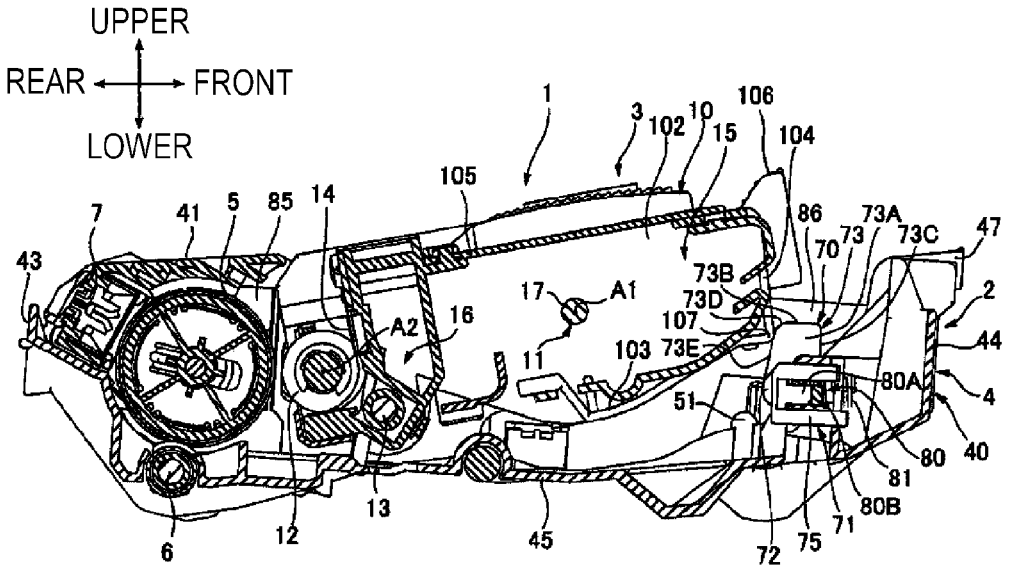
FIG. 9A illustrates an operation of mounting the developing cartridge to the drum cartridge, showing a state where an extension part of the developing cartridge abuts on a curved surface of the pressing member.

When mounting the developing cartridge 3 to the drum cartridge 2, the operator inserts the rear end portion of the developing cartridge 3 into the cartridge receiving part 86 of the drum cartridge 2 from above, as shown in FIG. 9A.

Figure 9B:
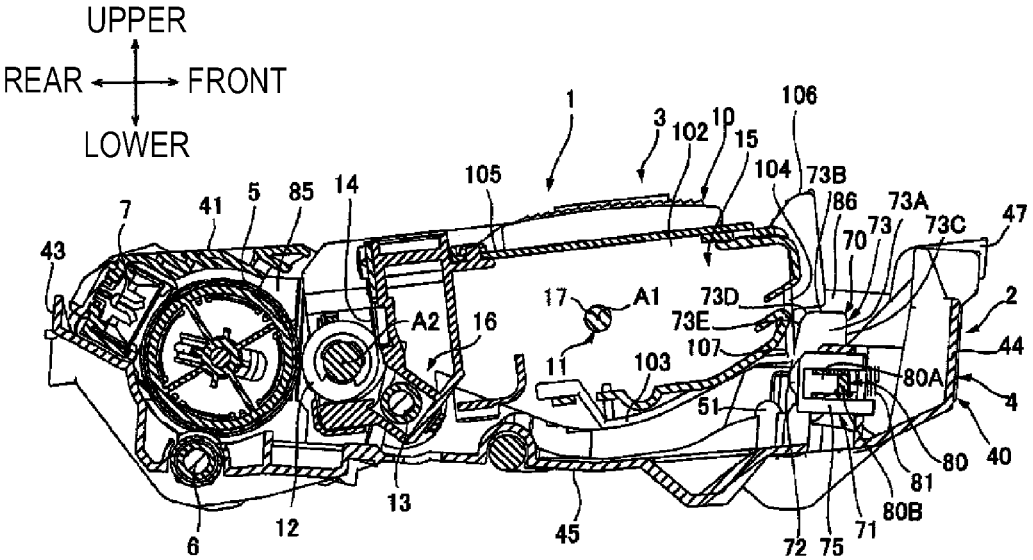
FIG. 9B illustrates the operation of mounting the developing cartridge to the drum cartridge subsequently to FIG. 9A, showing a state where the developing cartridge is located at a first position.

Thereby, the extension parts 107 of the developing cartridge 3 abut on the curved surfaces 73D of the pressing members 70 of the drum cartridge 2. Then, the extension parts 107 of the developing cartridge 3 are slid in the rear-lower direction along the curved surfaces 73D of the pressing members 70, abut on the guide surfaces 73E and are then moved in the rear-lower direction along the guide surfaces 73E, as shown in FIG. 9B. Thereby, the developing cartridge 3 is slowly moved in the rear-lower direction. Then, when the developing roller 12 abuts on the photosensitive drum 5 from the front, the developing cartridge 3 is restrained from being further moved in the rear-lower direction.

At this time, the developing cartridge 3 is located at a second position. When the developing cartridge 3 is located at the second position, the developing roller 12 abuts on the photosensitive drum 5 and the extension parts 107 abut on the guide surfaces 73E of the pressing members 70. While the developing cartridge 3 is located at the second position, the developing cartridge 3 is not completely mounted to the drum cartridge 2. That is, a position of the developing cartridge 3 at which the developing cartridge 3 can be separated from the drum cartridge 2 is the second position.

Subsequently, the operator presses the front end portion of the developing cartridge 3 downwards.

Thereby, the developing cartridge 3 is rotated in a clockwise direction about the rear end portion serving as a support point, as seen from the left side. At this time, the extension parts 107 of the developing cartridge 3 are moved in the rear-lower direction with being slid along the guide surfaces 73E of the pressing members 70 and abut on the pressing parts 72 of the pressing members 70. Thereby, the pressing members 70 are moved forwards against the urging force of the compression springs 81.

When the extension parts 107 abut on the abutting convex parts 51 from above, the developing cartridge 3 is restrained from being further moved, as shown in FIG. 1.

The pressing parts 72 of the pressing members 70 press the extension parts 107 of the developing cartridge 3 rearwards by the urging force of the compression springs 81. Thereby, the developing roller 12 is pressed to the photosensitive drum 5 by the pressing force from the pressing members 70. At this time, the developing cartridge 3 is located at a first position.

In this way, the mounting operation of the developing cartridge 3 to the drum cartridge 2 is completed.

5. Mounting of Process Cartridge to Apparatus Main Body

In order to mount the process cartridge 1 to the apparatus main body 21, the operator opens the front cover 25 and inserts the process cartridge 1 into the apparatus main body 21 from the rear end portion.

Figure 10A:
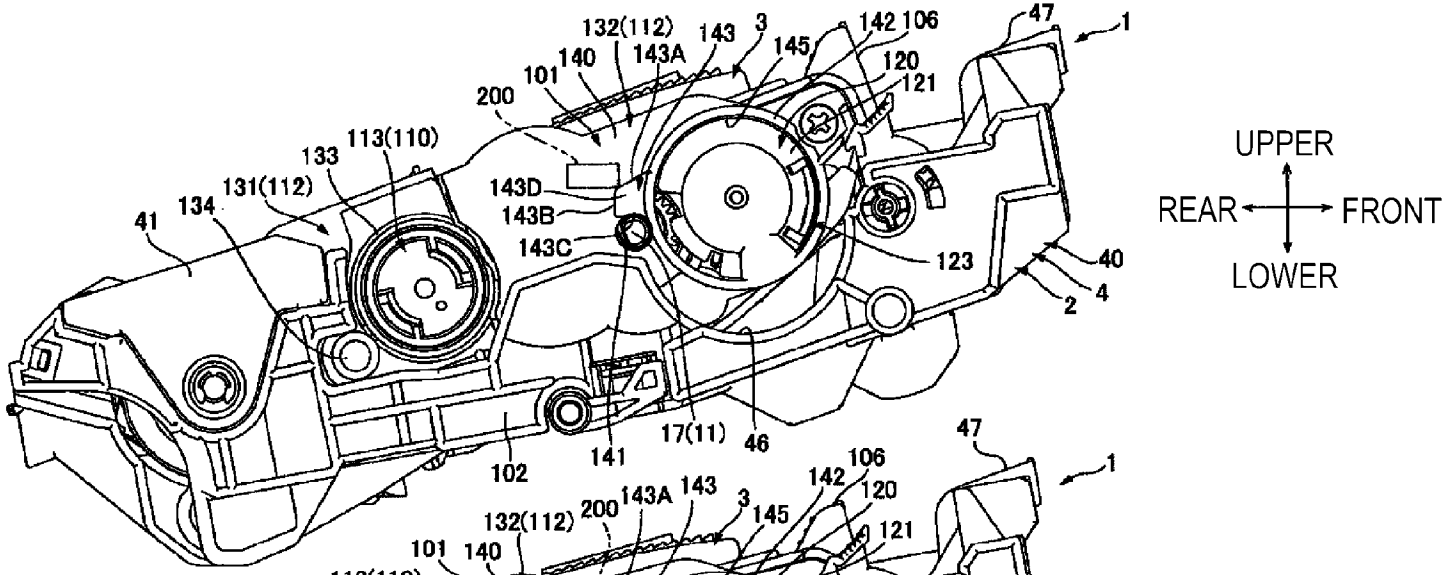
FIG. 10A is a left side view for illustrating the operation of mounting the developing cartridge to the drum cartridge, showing a state where the developing cartridge is located at a second position.

Here, as shown in FIG. 10A, the process cartridge 1 may be mounted to the apparatus main body 21 at a state where the developing cartridge 3 is imperfectly mounted to the drum cartridge 2. That is, as shown in FIG. 9B, the process cartridge 1 may be mounted to the apparatus main body 21 at a state where the developing cartridge 3 is located at the second position in the process cartridge 1.

In this case, when the operator pushes in the process cartridge 1 rearwards, an interference object 200, which is a member in the apparatus main body 21, abuts on the abutting surface 143A of the abutting part 143 of the developing cartridge 3 from the rear.

When the operator further pushes in the process cartridge 1 rearwards, the abutting surface 143A of the abutting part 143 of the developing cartridge 3 is pressed downwards by stress from the interference object 200.

Figure 10B:
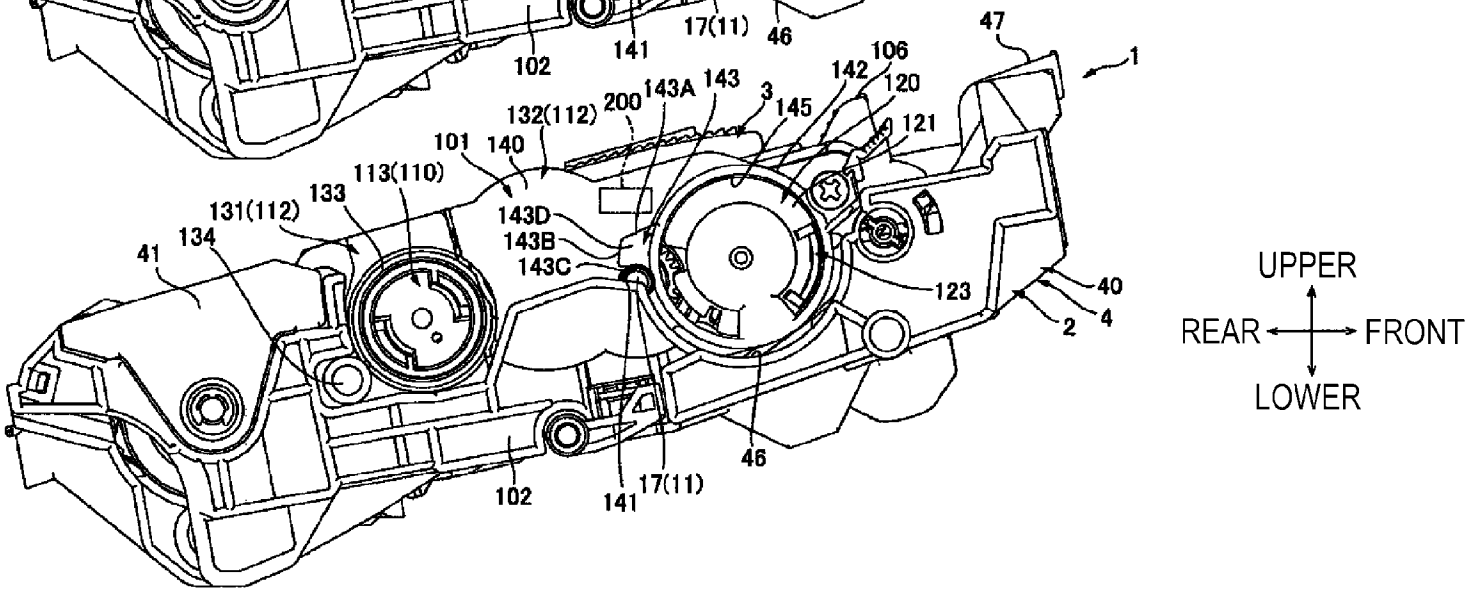
FIG. 10B is a left side view for illustrating the operation of mounting the developing cartridge to the drum cartridge subsequently to FIG. 10A, showing a state where the developing cartridge is located at the first position.

Then, as shown in FIGS. 9B and 10B, the front end portion of the developing cartridge 3 is received in the cartridge receiving part 86 so that it is rotated downwards about the rear end portion thereof.

Thereby, the developing cartridge 3 imperfectly mounted in the process cartridge 1 is perfectly mounted to the drum cartridge 2.

Thereafter, when the operator further pushes in the process cartridge 1 rearwards, the mounting of the process cartridge 1 to the apparatus main body 21 is completed, as shown in FIG. 1.

6. New Product Detection Operation

When the process cartridge 1 is mounted to the apparatus main body 21 and the front cover 25 is then closed, a main body coupling (not shown) serving as a driving source of the apparatus main body 21 is fitted to the developing coupling 113 so that it cannot be relatively rotated, in conjunction with the closing operation of the front cover 25. Then, the driving force is applied to the developing coupling 113.

Then, the driving force is applied to the agitator gear 117 of the idle gear 116, the agitator gear 117 is rotated in the clockwise direction, as seen from the left side, and the abutting rib 117C is engaged with the slide part 124 of the detection gear 120 when the developing cartridge 3 is a new product. The detection gear 120 is rotated in a counterclockwise direction, as seen from the left side. Thereby, the gear part 122 of the detection gear 120 is meshed with the second gear part 117B of the agitator gear 117, and the detection gear 120 is further rotated in the counterclockwise direction, as seen from the left side.

A detection device (not shown) detects the rotation of the detection part 123 of the detection gear 120, so that it is detected whether the developing cartridge 3 is a new product.

7. Operational Effects (1) As shown in FIG. 10A, according to the process cartridge 1 and the developing cartridge 3, the gear cover 112 includes the abutting part 143 protruding rearwards from the base part 140. When the process cartridge 1 is mounted to the apparatus main body at a state where the developing cartridge 3 is located at the second position, the abutting part 143 abuts on the interference object 200 in the apparatus main body 21, thereby moving the developing cartridge 3 to the first position.

For this reason, even though the developing cartridge 3 is located at the second position, the abutting part 143 abuts on the interference object 200 in the apparatus main body 21 at the time that the process cartridge 1 is mounted to the apparatus main body 21, so that it is possible to position the developing cartridge 3 at the first position.

As a result, it is possible to securely mount the developing cartridge 3 to the drum cartridge 2 at the state where the process cartridge 1 is mounted to the apparatus main body 21.

(2) As shown in FIG. 8A, according to the process cartridge 1, the abutting part 143 is located at the position at which it overlaps with the toner receiving chamber 15 in the left-right direction.

For this reason, it is possible to securely receive the toner receiving chamber 15 in the drum cartridge 2 at the time that the process cartridge 1 is mounted to the apparatus main body 21.

As a result, it is possible to securely receive the developing cartridge 3 in the drum cartridge 2.

(3) As shown in FIG. 8A, according to the process cartridge 1, the abutting part 143 is positioned above the rotational axis line A1 of the agitator 11.

For this reason, when the abutting part 143 abuts on the interference object 200 in the apparatus main body 21, the developing cartridge 3 is enabled to face downwards and can be thus securely received in the drum cartridge 2.

(4) As shown in FIG. 8A, according to the process cartridge 1, the abutting part 143 is positioned above the virtual line L3 connecting the rotational axis line A1 of the agitator 11 and the rotational axis line A2 of the developing roller 12.

For this reason, when the abutting part 143 abuts on the interference object 200 in the apparatus main body 21, the developing cartridge 3 is enabled to face downwards and can be thus securely received in the drum cartridge 2.

(5) As shown in FIG. 8A, according to the process cartridge 1, the abutting part 143 includes the abutting surface 143A, the first reinforcement surface 143B and the second reinforcement surface 143C.

For this reason, it is possible to reinforce the abutting surface 143A by the first reinforcement surface 143B and the second reinforcement surface 143C while the abutting surface 143A is enabled to abut on the interference object 200 in the apparatus main body 21.

As a result, it is possible to positively secure the abutting state between the abutting surface 143A and the interference object 200 in the apparatus main body 21.

(6) As shown in FIG. 8A, according to the process cartridge 1, the base part 140 includes the through-hole 141 overlapping with the agitator shaft 17 of the agitator 11.

For this reason, it is possible to check the phase of the agitator 11 through the through-hole 141.

The second reinforcement surface 143C has the shape conforming to the upper peripheral edge portion of the through-hole 141, when projected in the left-right direction.

For this reason, it is possible to effectively utilize a left region of the base part 140.

(7) As shown in FIG. 8A, according to the process cartridge 1, the abutting part 143 further includes the coupling surface 143D.

For this reason, it is possible to prevent the other member from being caught at the left end portions of the abutting surface 143A, the first reinforcement surface 143B and the second reinforcement surface 143C when mounting the process cartridge 1 to the apparatus main body 21.

(8) As shown in FIG. 8A, according to the process cartridge 1, the angle θ2 between the abutting surface 143A and the base part 140 is obtuse, when projected in the left-right direction.

For this reason, when the abutting part 143 abuts on the interference object 200 in the apparatus main body 21, the developing cartridge 3 is enabled to face downwards and can be thus securely received in the drum cartridge 2.

(9) As shown in FIG. 7, according to the process cartridge 1, the left end portion of the abutting part 143 is positioned at the left side of the left end portion of the developing coupling 113.

For this reason, it is possible to prevent the developing coupling 113 from being an obstacle when the abutting part 143 abuts on the interference object 200 in the apparatus main body 21.

As a result, it is possible to securely bring the abutting part 143 into contact with the interference object 200 in the apparatus main body 21.

(10) As shown in FIG. 6A, according to the process cartridge 1, the pressing member 70 includes the protrusion part 73 protruding rearwards from the main body part 71 and also protruding upwards from the main body part 71. The protrusion part 73 includes the guide surface 73A continuing to the pressing part 72 and configured to guide the developing cartridge 3 to the cartridge receiving part 86 of the drum cartridge 2.

For this reason, it is possible to smoothly receive the developing cartridge 3 in the cartridge receiving part 86.

It is possible to suppress the developing cartridge 3 from riding on and being engaged with the pressing parts 72.

As a result, it is possible to securely press the developing cartridge 3 towards the photosensitive drum 5.

(11) As shown in FIG. 6A, according to the process cartridge 1, the protrusion part 73 includes the curved surface 73D continuing to the guide surface 73E.

For this reason, it is possible to guide the developing cartridge 3 to the guide surfaces 73E through the curved surfaces 73D.

(12) As shown in FIG. 6B, according to the process cartridge 1, the angle between the guide surface 73E and the virtual line L2 is 45° or greater and less than 90°.

For this reason, it is possible to appropriately keep the inclined angle of the guide surface 73E so that the developing cartridge 3 can be smoothly received in the cartridge receiving part 86.

(13) As shown in FIG. 6B, according to the process cartridge 1, the angle between the guide surface 73E and the virtual line L2 is 65° or greater and 85° or less.

For this reason, it is possible to appropriately keep the inclined angle of the guide surface 73E so that the developing cartridge 3 can be smoothly received in the cartridge receiving part 86.

(14) As shown in FIG. 6B, according to the process cartridge 1, the guide surface 73E continues to the pressing part 72, and overlaps with the pressing part 72, when projected in the upper-lower direction.

For this reason, it is possible to further suppress the developing cartridge 3 from riding on and being engaged with the pressing parts 72.

8. Modified Embodiments

In the above illustrative first embodiment, the developing cartridge 3 includes the developing roller 12. However, the developing cartridge 3 may be configured to have a developing sleeve including a magnetic roller therein, instead of the developing roller 12, for example.

In the above illustrative embodiment, the first cover 131 and the second cover 132 are separately configured. However, the first cover 131 and the second cover 132 may also be integrally configured.

In the above illustrative embodiment, the second cover 132 is configured to cover the idle gear 116, the agitator gear 117 and the detection gear 120. However, the second cover 132 may be configured to cover at least a part of the idle gear 116, the agitator gear 117 and the detection gear 120.

In the above illustrative embodiment, the second cover 132 of the gear cover 112 includes the abutting part 143. However, the abutting part 143 may be configured as a separate member from the gear cover 112.

In the above illustrative embodiment, the detection gear 120 includes the gear part 122. However, the detection gear 120 may be configured to include a frictional member such as an elastic member, instead of the gear part 122, for example.

In the above illustrative embodiment, the left surface of the abutting part 143 is configured by the coupling surface 143D. However, the abutting part 143 may be configured to have an opened left side.

In the above illustrative embodiment, the left wall of the base part 140 of the second cover 132 is configured to be orthogonal to the left-right direction. However, it is not necessarily required that the left wall of the base part 140 of the second cover 132 be completely orthogonal to the left-right direction. That is, the left wall of the base part 140 of the second cover 132 may be configured to have only to cover the gear train 110 from the left. For example, the left wall of the base part 140 of the second cover 132 may be inclined relative to the sidewall 102 within a range not obstructing the rotations of the respective gears.

Second Embodiment

A second embodiment of the present disclosure will be described hereinafter with reference to FIGS. 11 to 20.

1. Outline of Process Cartridge

As shown in FIG. 311, a process cartridge 313 includes a drum cartridge 301, which is an example of the photosensitive member cartridge, and a developing cartridge 320.

The drum cartridge 301 includes a drum frame 331, which is an example of the second housing, a photosensitive drum 302, which is an example of the photosensitive member, a transfer roller 304 and a scorotron-type charger 303.

The drum frame 331 has a substantially rectangular bottomed frame shape extending in the left-right direction, as seen from above.

The photosensitive drum 302 is positioned at a rear end portion of the drum frame 331. The photosensitive drum 302 has a substantially cylindrical shape extending in the left-right direction. The photosensitive drum 302 is rotatably supported at both left and right end portions thereof to the drum frame 331, so that it can be rotated about a rotational axis line extending in the left-right direction.

The transfer roller 304 is rotatably supported to a rear lower end portion of the drum frame 331. The transfer roller 304 is positioned below the photosensitive drum 302. The transfer roller 304 has a substantially cylindrical shape, and an upper end portion thereof is contacted to a lower end portion of the photosensitive drum 302.

The scorotron-type charger 303 is positioned at a rear-upper side of the photosensitive drum 302.

The developing cartridge 320 includes a developing frame 361, which is an example of the first housing, an agitator 325, which is an example of the agitation member, a developing roller 321, a supply roller 322 and a layer thickness regulation blade 323.

The developing frame 361 has a substantial box shape extending in the left-right direction. A rear end portion of the developing frame 361 is opened in the front-rear direction. The developing frame 361 includes therein a toner receiving chamber 324, which is an example of the developer receiving chamber, and a developing chamber. The toner receiving chamber 324 and the developing chamber are provided in parallel in the front-rear direction. The toner is received in the toner receiving chamber 324.

The agitator 325 is positioned at a substantial central part of the toner receiving chamber 324 in the front-rear and upper-lower directions. The agitator 325 includes an agitator shaft, which is an example of the rotational shaft, and an agitation blade. The agitator shaft has a substantially cylindrical shape extending in the left-right direction. The agitation blade extends from the agitator shaft towards a diametrically outer side of the agitator shaft. Both left and right end portions of the agitator shaft are rotatably supported to the developing frame 361, so that the agitator 325 can be rotated about a rotational axis line extending in the left-right direction, which is an example of the first rotational axis line.

The developing roller 321 is positioned at a rear end portion of the developing chamber. The developing roller 321 has a substantially cylindrical shape extending in the left-right direction. Both left and right end portions of the developing roller 321 are rotatably supported to the developing frame 361, so that the developing roller 321 can be rotated. A rear part of the developing roller 321 is exposed from the developing frame 361. A rear end portion of the developing roller 321 is contacted to a front lower end portion of the photosensitive drum 302.

The supply roller 322 is positioned at a front-lower side of the developing roller 321 in the developing chamber. The supply roller 322 has substantially cylindrical shape extending in the left-right direction. Both left and right end portions of the supply roller 322 are rotatably supported to the developing frame 361, so that the supply roller 322 can be rotated about an axis line extending in the left-right direction. A rear upper end portion of the supply roller 322 is contacted to a front lower end portion of the developing roller 321.

The layer thickness regulation blade 323 extends in the upper-lower direction in front of the developing roller 321, and a lower end portion thereof is contacted to a front end portion of the developing roller 321.

2. Using Aspect of Process Cartridge

Figure 11:
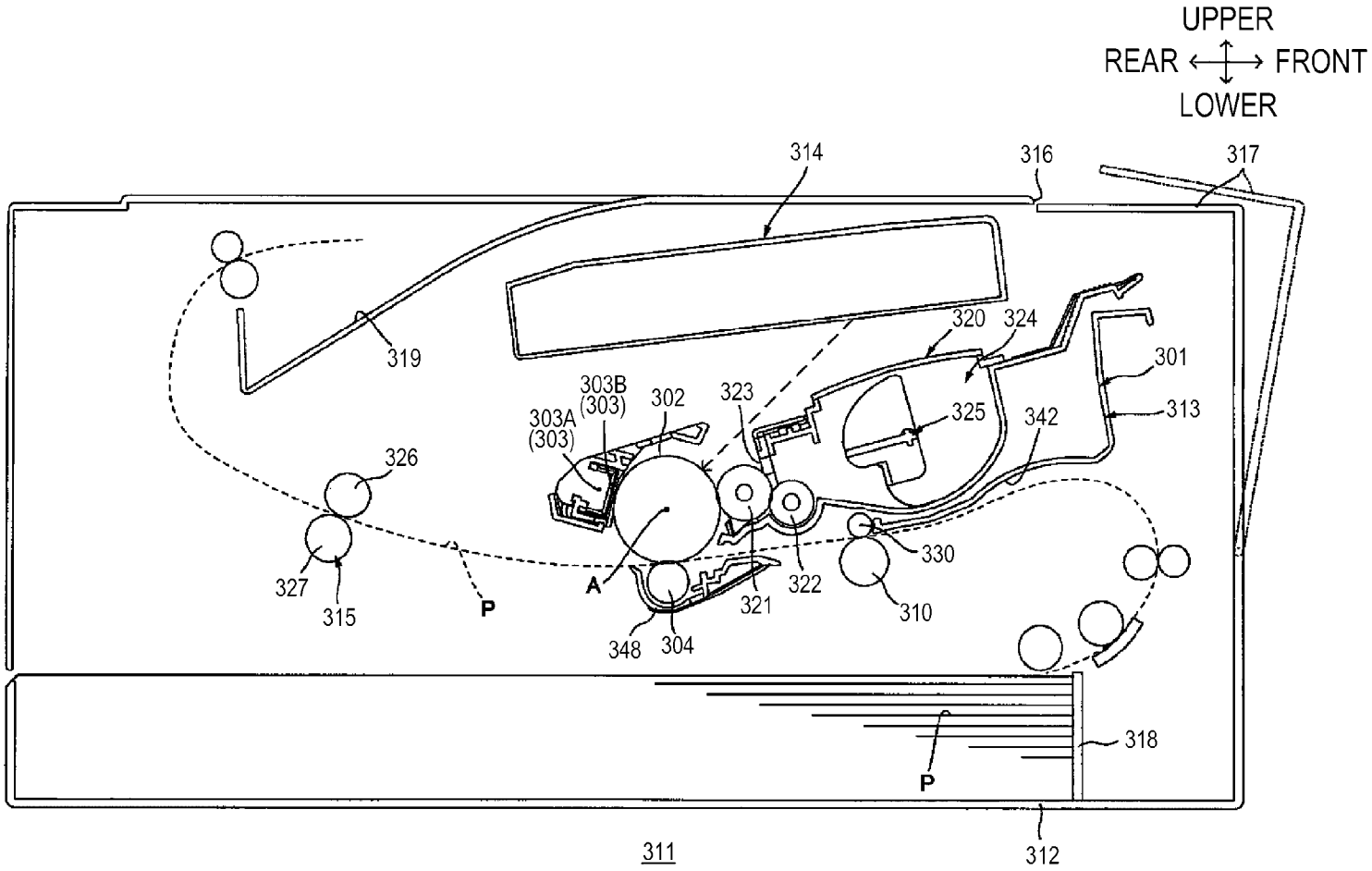
FIG. 11 is a central sectional view of a printer to which a drum cartridge which is an example of a photosensitive member cartridge according to a second embodiment is attached.

As shown in FIG. 11, the process cartridge 313 is used with being mounted to an image forming apparatus 311.

The image forming apparatus 311 is an electrophotographic monochrome printer. The image forming apparatus 311 includes an apparatus main body 312, which is an example of the image forming apparatus main body, the process cartridge 313, a scanner unit 314 and a fixing unit 315.

The apparatus main body 312 has a substantial box shape. The apparatus main body 312 includes an opening 316, a front cover 317, a sheet feeding tray 318 and a sheet discharge tray 319.

The opening 316 is opened at a front wall of the apparatus main body 312. The opening 316 is configured to communicate the inside and outside of the apparatus main body 312 in the front-rear direction so that the process cartridge 313 can pass therethrough.

The front cover 317 is positioned at a front end portion of the apparatus main body 312. The front cover 317 has a substantially flat plate shape. The front cover 317 extends in the upper-lower direction and is swingably supported to the front wall of the apparatus main body 312 at a lower end portion thereof serving as a support point. The front cover 317 is configured to open or close the opening 316.

The sheet feeding tray 318 is positioned at a bottom of the apparatus main body 312. The sheet feeding tray 318 is configured to receive therein sheets P.

The sheet discharge tray 319 is positioned at a rear half part of an upper wall of the apparatus main body 312. The sheet discharge tray 19 is formed to have a recess shape downwardly from an upper surface of the apparatus main body 312 so that the sheets P can be placed thereon.

The process cartridge 313 is received at a substantial center of the apparatus main body 312 in the upper-lower direction. The process cartridge 313 is configured to be mounted or demounted to or from the apparatus main body 312.

The scanner unit 314 is arranged above the process cartridge 313. The scanner unit 314 is configured to emit a laser beam based on image data towards the photosensitive drum 302.

The fixing unit 315 is arranged at the rear of the process cartridge 313. The fixing unit 315 includes a heating roller 326 and a pressing roller 327 pressure-contacted to a rear lower end portion of the heating roller 326.

When the image forming apparatus 311 starts an image forming operation, the scorotron-type charger 303 uniformly charges a surface of the photosensitive drum 302.

The scanner unit 314 exposes the surface of the photosensitive drum 302 on the basis of the image data. Thereby, an electrostatic latent image based on the image data is formed on the surface of the photosensitive drum 302.

The agitator 325 agitates the toner in the toner receiving chamber 324, thereby supplying the same to the supply roller 322. The supply roller 322 supplies the toner supplied by the agitator 325 to the developing roller 321. At this time, the toner is carried on the developing roller 321 with being positively friction-charged between the developing roller 321 and the supply roller 322. The layer thickness regulation blade 323 regulates a layer thickness of the toner carried on the developing roller 321 to a predetermined thickness.

The toner carried on the developing roller 321 is supplied to the electrostatic latent image on the surface of the photosensitive drum 302. Thereby, a toner image is carried on the surface of the photosensitive drum 302.

The sheet P is fed one by one at predetermined timing from the sheet feeding tray 318 towards between the photosensitive drum 302 and the transfer roller 304 by rotations of various rollers. The toner image on the surface of the photosensitive drum 302 is transferred to the sheet P while the sheet P passes between the photosensitive drum 302 and the transfer roller 304.

After that, the sheet P is heated and pressed while it passes between the heating roller 326 and the pressing roller 327. Thereby, the toner image on the sheet P is heat-fixed on the sheet P. Thereafter, the sheet P is discharged to the sheet discharge tray 19.

3. Details of Process Cartridge (1) Drum Cartridge

The drum cartridge 301 includes a base frame 332 and a cover frame 333.

(1-1) Base Frame

The base frame 332 has a substantially rectangular bottomed frame shape, as seen from above. The base frame 332 integrally includes a pair of sidewalls 334, a rear wall 336, a front wall 337 and a lower wall 335.

The pair of sidewalls 334 is positioned at both left and right end portions of the drum cartridge 1, respectively. That is, the pair of sidewalls 334 is arranged at an interval with each other in the left-right direction. Each of the pair of sidewalls 334 has a substantially rectangular flat plate shape extending in the front-rear and upper-lower directions, as seen from the side. Each of the pair of sidewalls 334 includes a collar guide part 338 and an abutting boss 340, which is an example of the boss. The left sidewall 334, which is an example of the first sidewall, includes an receiving part 339. In the meantime, the right sidewall 334 is an example of the second sidewall.

The collar guide part 338 is arranged at a substantial center of the sidewall 334 in the front-rear direction. The collar guide part 338 has a substantial U shape recessed downwards from an upper end portion of the sidewall 334 and including an opened upper end portion, as seen from the side. The collar guide part 338 includes a collar fitting part 338A.

The collar fitting part 338A is arranged at a rear lower end portion of the collar guide part 338. The collar fitting part 338A has a substantial U shape recessed rearwards and including an opened front end portion, as seen from the side.

The abutting boss 340 is arranged at a front end portion of the sidewall 334. The abutting boss 340 has a substantially cylindrical shape extending from an outer surface of the sidewall 334 in the left-right direction towards an outer side in the left-right direction.

The receiving part 339 is arranged at the rear of the abutting boss 340 at the front end portion of the left sidewall 334. The receiving part 339 has a substantially semi-circular shape including an opened upper end portion, as seen from the side.

Figure 14:
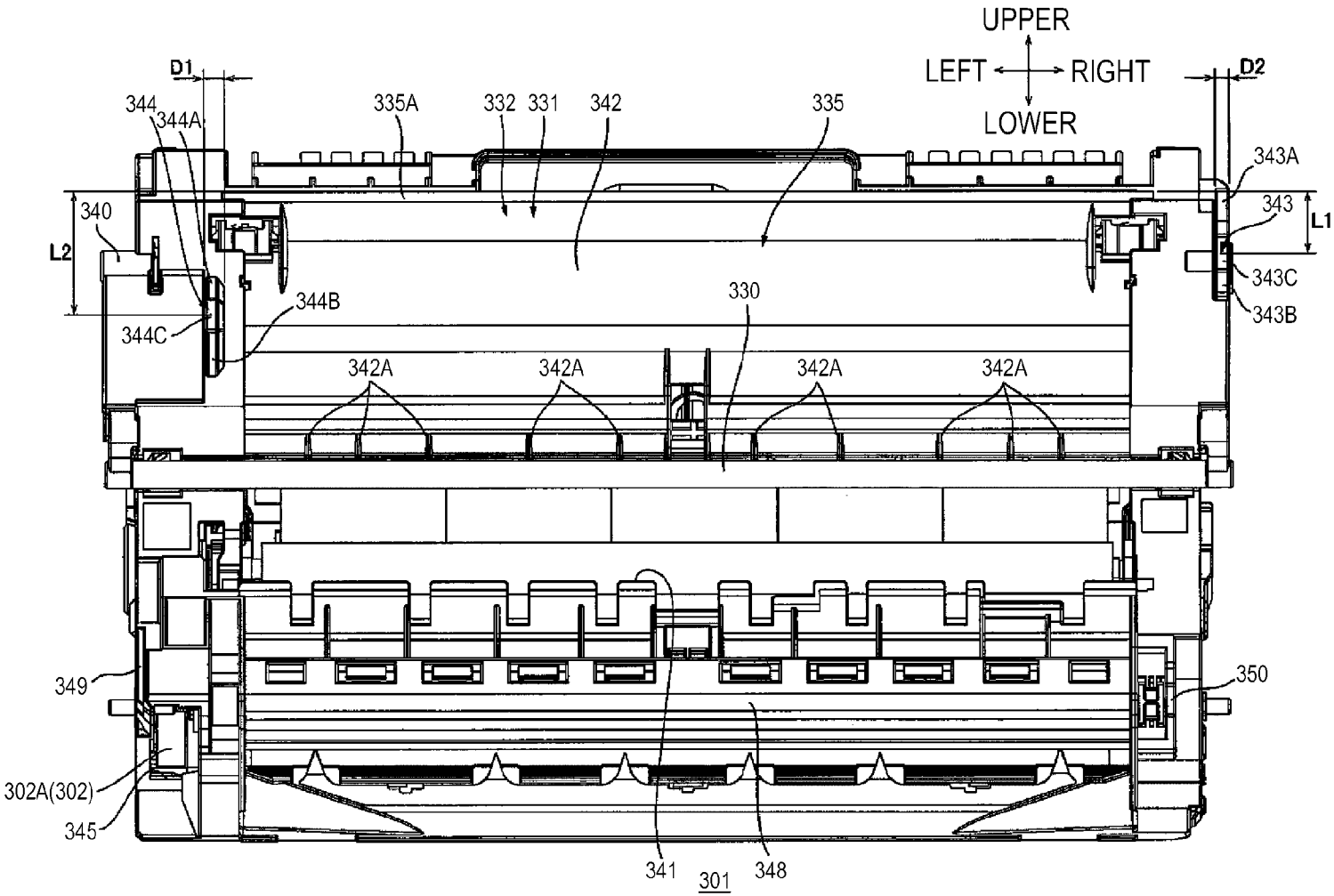
FIG. 14 is a bottom view of the drum cartridge shown in FIG. 12.

The lower wall 335 is bridged between lower end portions of the pair of sidewalls 334 and extends in the front-rear direction. That is, the lower wall 335 is configured to couple the lower end portions of the pair of sidewalls 334. The lower wall 335 has a substantially rectangular flat plate shape, as seen from above. As shown in FIG. 14, the lower wall 335 includes a sheet passing opening 341, a sheet guide part 342, which is an example of the guide part, a covering part 348, a left rib 344, which is an example of the first leg part, a right rib 343, which is an example of the second leg part, a left protrusion wall 349, which is an example of the third leg part, and a right protrusion wall 350, which is an example of the third leg part.

The sheet passing opening 341 is arranged at a substantial center of the lower wall 335 in the front-rear direction. The sheet passing opening 341 has a substantially rectangular shape extending over the substantially entire lower wall 335 in the left-right direction, as seen from below. The sheet passing opening 341 is configured to permit the sheet P, which is fed between the photosensitive drum 302 and the transfer roller 304 as the register roller 310 is rotated, to pass therethrough.

The sheet guide part 342 is arranged in front of the sheet passing opening 341. The sheet guide part 342 is slightly recessed from a lower surface of the lower wall 335 and extends in the front-rear direction over the substantially same length in the left-right direction as the sheet passing opening 341. The sheet guide part 342 includes conveyance ribs 342A, which are an example of a plurality of projections.

The plurality of conveyance ribs 342A is arranged at an interval with each other in the left-right direction at a rear end portion of the sheet guide part 342. Each of the plurality of conveyance ribs 342A is a projection slightly protruding downwards from a lower surface of the sheet guide part 342 and extending in the front-rear direction.

The covering part 348 is arranged below the transfer roller 304 at the rear of the sheet passing opening 341. The covering part 348 has a substantially semi-cylindrical shape extending in the left-right direction and bulging downwards at a center thereof in the front-rear direction. The covering part 348 is configured to cover the transfer roller 304.

Figure 13:
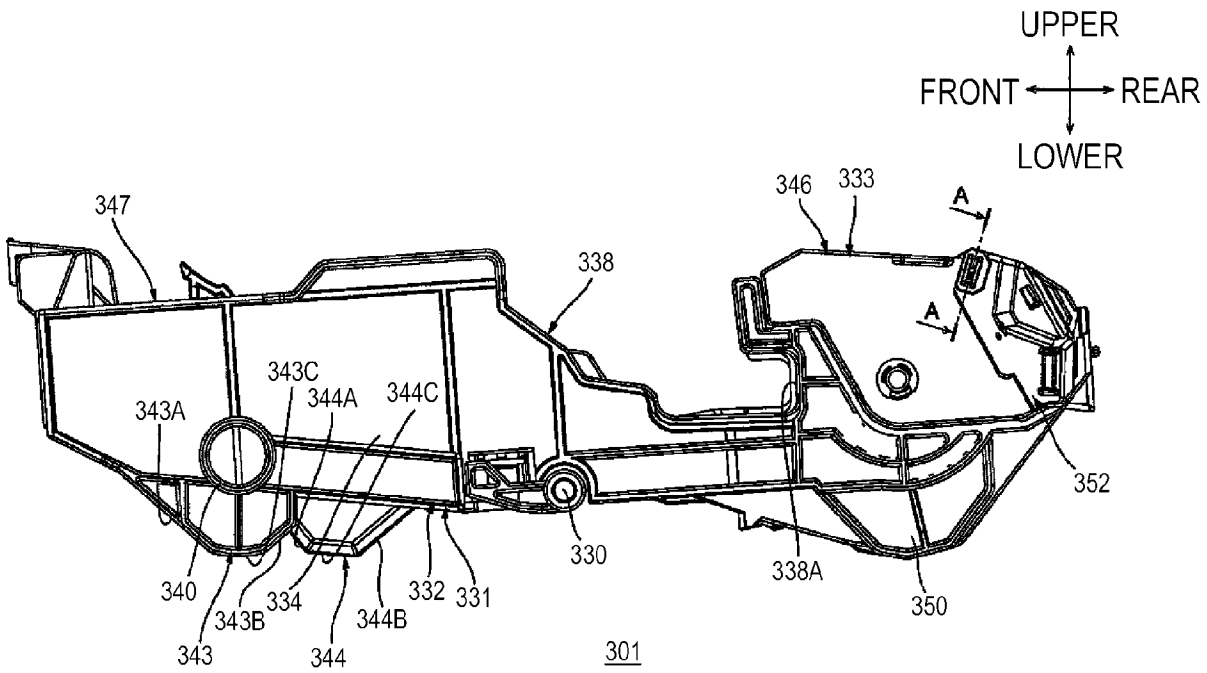
FIG. 13 is a right side view of the drum cartridge shown in FIG. 12.

As shown in FIGS. 13 and 14, the left rib 344 is arranged at the left of the sheet guide part 342 at the front end portion of the lower wall 335. The left rib 344 has a substantially triangular plate shape extending more downwards from the lower surface of the lower wall 335 than the conveyance ribs 342A and extending in the front-rear direction, as seen from the side. A lower end portion 344C of the left rib 344 is a tip of the left rib 344. A front surface 344A of the left rib 344 is inclined downwards as it faces rearwards. The front surface 344A of the left rib 344 is an example of the first inclined part. A rear surface 344B of the left rib 344 is inclined downwards as it faces forwards. A size D1 of the left rib 344 in the left-right direction is 2 mm or greater and 37 mm or less, for example. Specifically, the size D1 is 5.8 mm.

The right rib 343 is arranged at the right of the sheet guide part 342 at the front end portion of the lower wall 335. The right rib 343 has a substantially triangular plate shape extending more downwards from a lower end portion of the left abutting boss 340 than the conveyance ribs 342A and extending in the front-rear direction, as seen from the side. A lower end portion 343C of the right rib 343 is a tip of the right rib 343. A front surface 343A of the right rib 343 is inclined downwards as it faces rearwards. The front surface 343A of the right rib 343 is an example of the second inclined part. A rear surface 343B of the right rib 343 is inclined downwards as it faces forwards. The lower end portion 343C of the right rib 343 is arranged at the front of the lower end portion 344C of the left rib 344, when projected in the left-right direction. That is, a distance L1 in the front-rear direction between the lower end portion 43C of the right rib 343 and a front end portion 335A of the lower wall 335 is shorter than a distance L2 in the front-rear direction between the lower end portion 344C of the left rib 344 and the front end portion 335A of the lower wall 335. In the meantime, the front end portion 335A of the lower wall 335 is an example of the end portion of the lower wall 335. A rear end portion of the right rib 343 is arranged to overlap with a front end portion of the left rib 344, when projected in the left-right direction. A size D2 of the right rib 343 in the left-right direction is 2 mm or greater and 3.5 mm or less, for example. Specifically, the size D2 is 2.6 mm.

The left protrusion wall 349 is arranged at the left of the covering part 348 at a rear end portion of the lower wall 335. The left protrusion wall 349 has a substantially triangular plate shape protruding more downwards from the lower surface of the lower wall 335 than the covering part 348 and extending in the front-rear direction. The left protrusion wall 349 is arranged at the left of the left rib 344.

The right protrusion wall 350 is arranged at the right of the covering part 348 at the rear end portion of the lower wall 335. The right protrusion wall 350 has a substantially triangular plate shape protruding more downwards from the lower surface of the lower wall 335 than the covering part 348 and extending in the front-rear direction. The right protrusion wall 350 is arranged at the left of the right rib 343. The right protrusion wall 350 is configured to interpose the transfer roller 304 between the right protrusion wall 350 and the left protrusion wall 349 in the left-right direction.

The rear wall 336 has a flat plate shape protruding upwards from the rear end portion of the lower wall 335 and extending in the left-right direction. The rear wall 336 includes an exposed opening 345.

Figure 12:
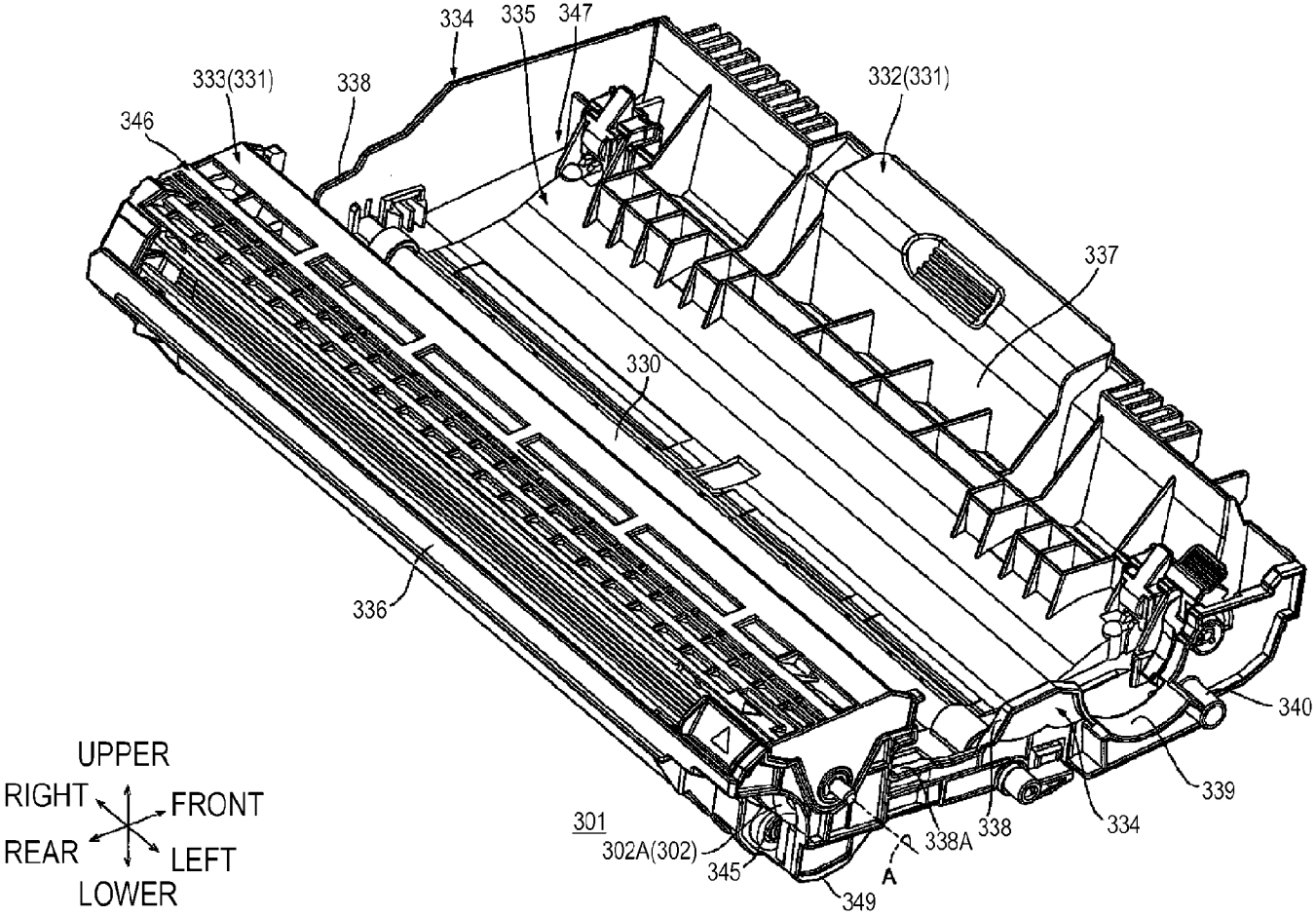
FIG. 12 is a perspective view of the process cartridge shown in FIG. 11, as seen from the left-upper side.

The exposed opening 345 is arranged at a left end portion of the rear wall 336, as shown in FIG. 12. The exposed opening 345 has a substantially rectangular shape, as seen from the back. The exposed opening 345 is formed to penetrate the rear wall 336 in the front-rear direction. The exposed opening 345 is configured to expose a rear lower end portion of the drum gear 302A of the photosensitive drum 302.

The front wall 337 continues to the front end portion 335A of the lower wall 335 and extends upwards. The front wall 337 has a substantially rectangular flat plate shape, as seen from the front. Both left and right end portions of the front wall 337 continue to the front end portions of the pair of sidewalls 334.

Figure 15B:
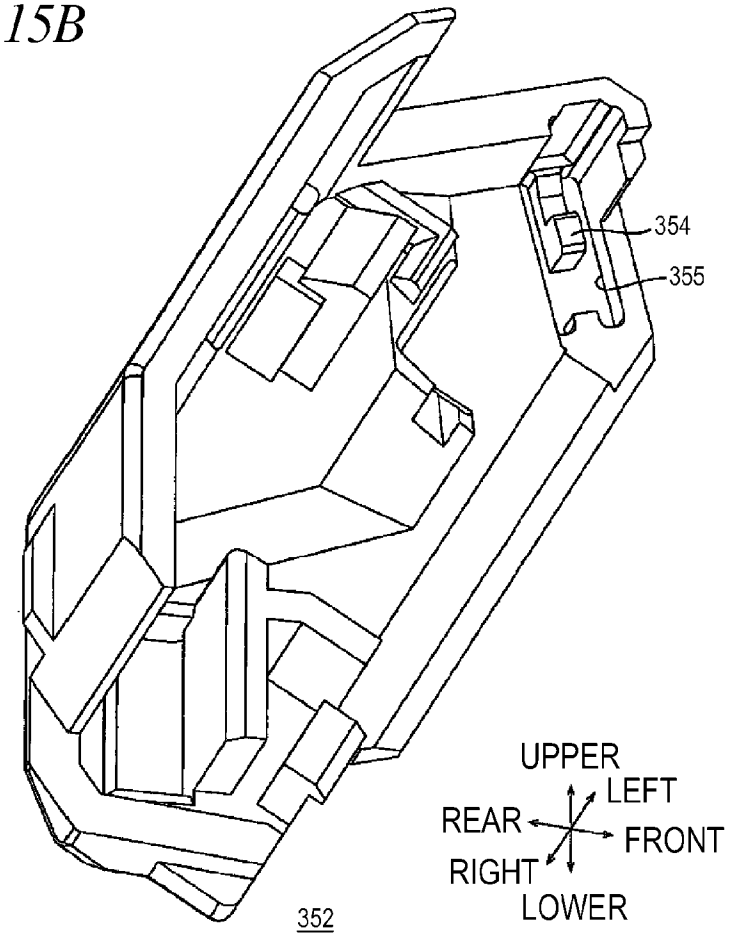
FIG. 15B is a perspective view of the cover shown in FIG. 13 as seen from the left-lower side.
Figure 15A:
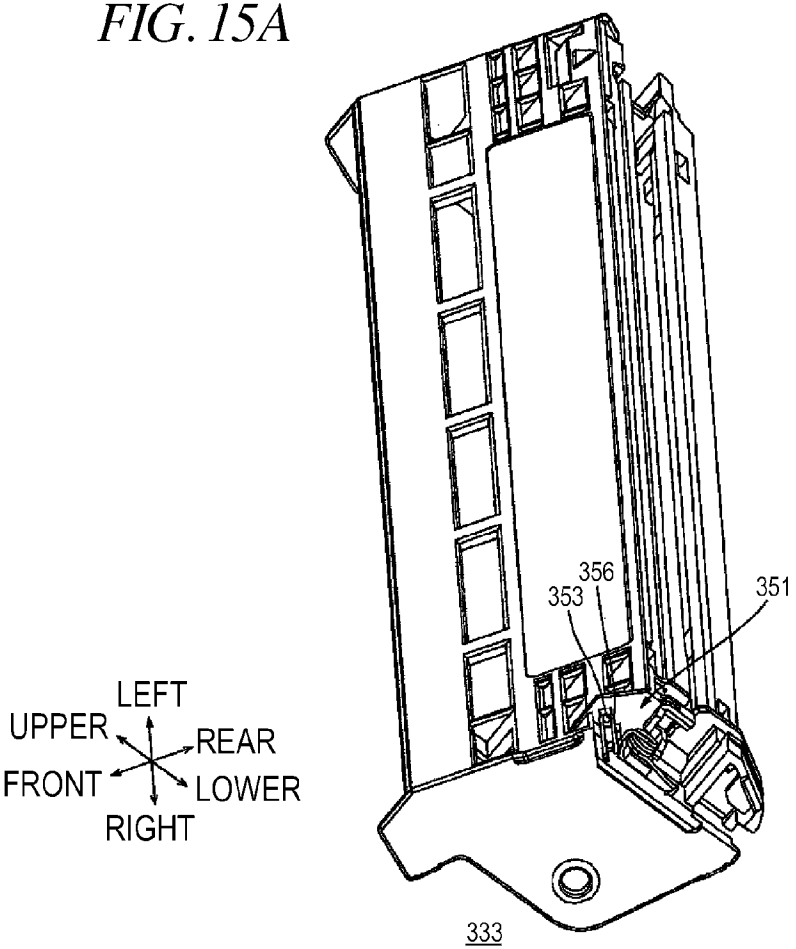
FIG. 15A is a perspective view of a cover frame shown in FIG. 13 as seen from the right-upper side and shows a state that an electrode support part is removed from the cover.

The cover frame 333 is arranged above the rear end portion of the base frame 332 to cover the photosensitive drum 302. The cover frame 333 is configured to support the scorotron-type charger 303. As shown in FIGS. 15A and 15B, the cover frame 333 includes an electrode support part 351 and a cover 352.

The electrode support part 351 is arranged at a rear end portion of the cover frame 333. The electrode support part 351 has a substantially rectangular shape recessed leftwards from a right surface of the cover frame 333, as seen from the side. The electrode support part 351 includes an engaging claw 353 and a wire electrode 356.

Figure 16:
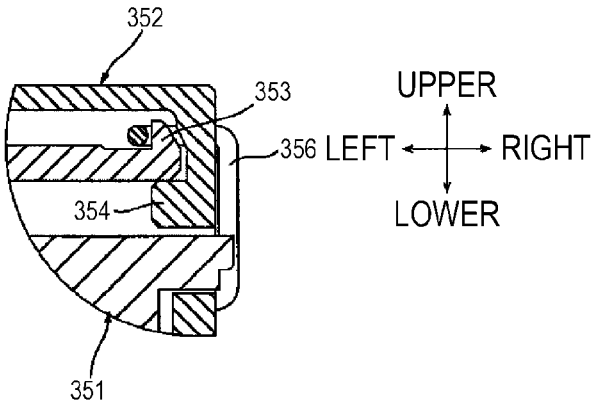
FIG. 16 is an A-A sectional view of FIG. 13.

As shown in FIGS. 15A and 16, the engaging claw 353 is arranged in an upper end portion of the electrode support part 351. The engaging claw 353 has a substantial hook shape extending in the left-right direction and including a left end portion bent upwards.

The wire electrode 356 has a substantial U shape of which a lower end portion is opened, as seen from the side, and is engaged at an upper end portion thereof with the engaging claw 353. The wire electrode 356 is electrically connected to the wire 303A of the scorotron-type charger 303.

As shown in FIGS. 13 and 15B, the cover 352 has a substantially flat plate shape extending in the upper-lower direction. The cover 352 is arranged at the rear end portion of the cover frame 333 to cover the electrode support part 351. The cover 352 includes an electrode exposing hole 355 and a support claw 354.

The electrode exposing hole 355 is arranged at an upper end portion of the cover 352. The electrode exposing hole 355 has a substantially rectangular shape, as seen from the side. The electrode exposing hole 355 is configured to expose the wire electrode 356.

The support claw 354 has a substantial hook shape extending downwards from a substantial center of an upper edge of the electrode exposing hole 355 in the front-rear direction and including a lower end portion bent leftwards. As shown in FIG. 16, the support claw 354 is engaged with a lower end portion of a right end portion of the engaging claw 353. Thereby, the support claw 354 suppresses the right end portion of the engaging claw 353 from being bent downwards.

As shown in FIG. 12, a part having a substantial box shape configured by the cover frame 333, the pair of sidewalls 334 and the covering part 48 of the drum cartridge 301 is a drum receiving part 346, which is an example of the photosensitive member receiving part configured to support the photosensitive drum 302.

A part demarcated by the front end portion of the cover frame 333, the pair of sidewalls 334 and the front wall 337 in front of the cover frame 333 is a developing cartridge mounting part 347, which is an example of the cartridge receiving part to which the developing cartridge 320 is mounted.

The backup roller 330 is rotatably supported to a substantial center of a lower end portion of the drum frame 331 in the front-rear direction. The backup roller 330 has a substantially cylindrical shape extending in the left-right direction. As shown in FIG. 11, the backup roller 330 is configured to contact the upper end portion of the register roller 310 of the apparatus main body 312 at a state where the process cartridge 313 is mounted in the apparatus main body 312.

4. Details of Developing Cartridge

Figures 17A, 17B:
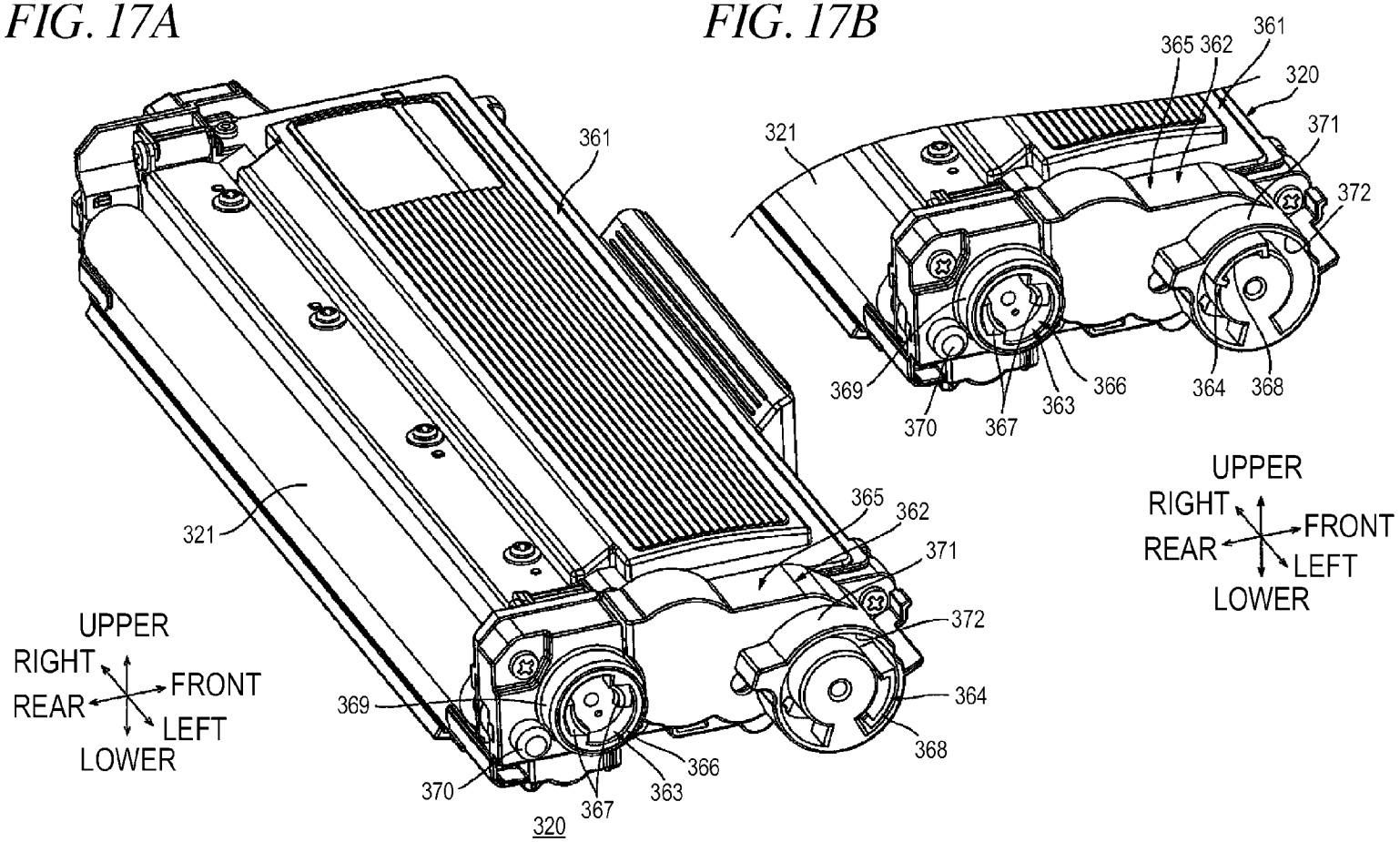
FIG. 17A is a perspective view of the developing cartridge shown in FIG. 11 as seen from the left-upper side.
FIG. 17B illustrates an operation in which the detected gear advances.

As shown in FIGS. 17A and 17B, the developing cartridge 320 includes a developing frame 361, which is an example of the housing, and a driving unit 362.

The developing frame 361 has a substantial box shape extending in the left-right direction. The developing frame 361 is configured to support the developing roller 321, the supply roller 322, the layer thickness regulation blade 323 and the agitator 325, and includes the toner receiving part 324.

The driving unit 362 is arranged at the left of the developing frame 361 at the left end portion of the developing cartridge 320. The driving unit 362 includes a developing coupling 363, a detection gear 364, which is an example of the detected member, and a gear cover 365.

The developing coupling 363 is positioned at a rear end portion of the driving unit 362. The developing coupling 363 has a substantially cylindrical shape extending in the left-right direction. A substantial right half part of the developing coupling 363 includes gear teeth over an entire periphery thereof. The developing coupling 363 is coupled to transmit a driving force to the developing roller 321, the supply roller 322 and the agitator 325 through a gear train (not shown) in the driving unit 362. The developing coupling 363 includes a coupling part 366.

The coupling part 366 is arranged at a substantial right half part of the developing coupling 363. The coupling part 366 has a substantially cylindrical shape extending in the left-right direction. The coupling part 366 includes a pair of engaging parts 367.

The pair of engaging parts 367 is respectively arranged at both diametrical end portions of the coupling part 366. Each of the pair of engaging parts 367 has a substantially trapezoidal shape bulging from an inner periphery of the coupling part 366 towards a diametrically inner side of the coupling part 366 and extending in a circumferential direction of the 366, as seen from the side.

The detection gear 364 has a substantially cylindrical shape extending in the left-right direction. The detection gear 364 includes a tooth lacking gear (not shown) configured to mesh with the gear train (not shown) in the driving unit 362 at a right end portion thereof. While the detection gear 364 is meshed with the gear train (not shown) in the driving unit 362, the detection gear 364 advances leftwards with rotating, as shown in FIG. 17B, and when the meshing with the gear train (not shown) in the driving unit 362 is released, the detection gear 364 is stopped. In the meantime, the detection gear 364 is configured to retreat rightwards by an urging force of an urging member (not shown) after it is stopped. The detection gear 364 includes a detection part 368.

The detection part 368 is arranged at a peripheral edge portion of the detection gear 364. The detection part 368 has a substantially curved plate shape protruding leftwards from a left surface of the detection gear 364 and extending along a circumferential direction of the detection gear 364.

The gear cover 365 has a substantial square tube shape of which a right end portion is opened, and is configured to cover the developing coupling 363, the gear train (not shown) and the detection gear 364. The gear cover 365 includes a coupling collar 369, a developing roller shaft collar 370 and a detection gear receiving part 371.

The coupling collar 369 is arranged at a center of the gear cover 365. The coupling collar 369 has a substantially cylindrical shape extending in the left-right direction. The coupling collar 369 is fitted to the coupling part 366 of the developing coupling 363.

The developing roller shaft collar 370 is arranged below the rear of the coupling collar 369. The developing roller shaft collar 370 has a substantially cylindrical shape extending in the left-right direction and including a closed left end portion. The developing roller shaft collar 370 is fitted to a left end portion of the rotational shaft of the developing roller 321.

The detection gear receiving part 371 is arranged at a front end portion of the gear cover 365. The detection gear receiving part 371 has a substantially cylindrical shape extending leftwards from a left surface of the gear cover 365 and including a closed left end portion. The detection gear receiving part 371 is configured to receive therein the detection gear 364. The detection gear receiving part 371 includes an exposed hole 372.

The exposed hole 372 has a substantial C shape including an opened lower end portion, as seen from the side, along a peripheral edge portion of a left wall of the detection gear receiving part 371. The exposed hole 372 is formed to penetrate the left wall of the detection gear receiving part 371 in the left-right direction. The exposed hole 372 is configured to receive therein the detection part 368 of the detection gear 364.

5. Attaching and Detaching of Process Cartridge to and from Apparatus Main Body

Figure 18A:
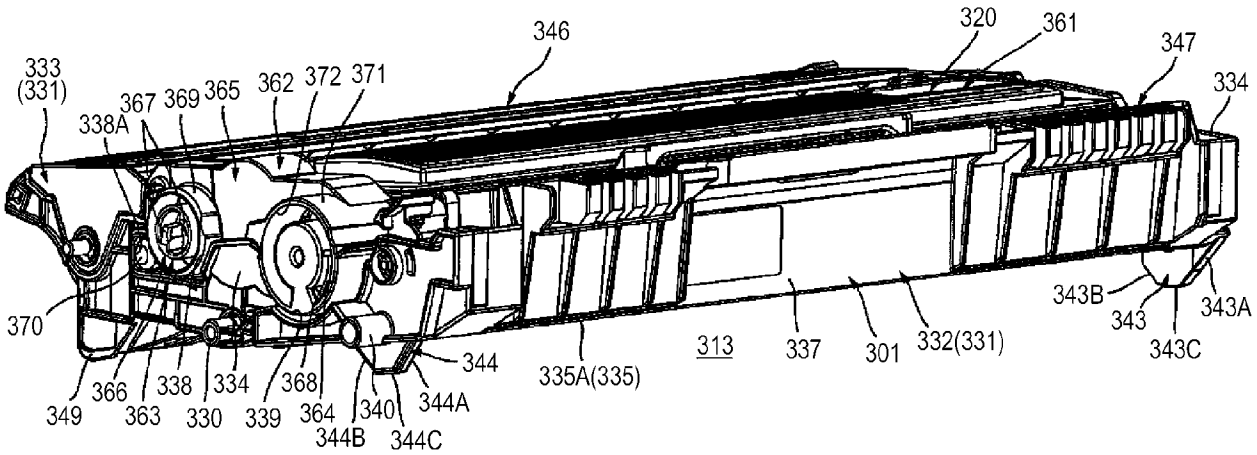
FIG. 18A is a perspective view of a process cartridge shown in FIG. 11 as seen from the left-upper side.
Figure 18B:
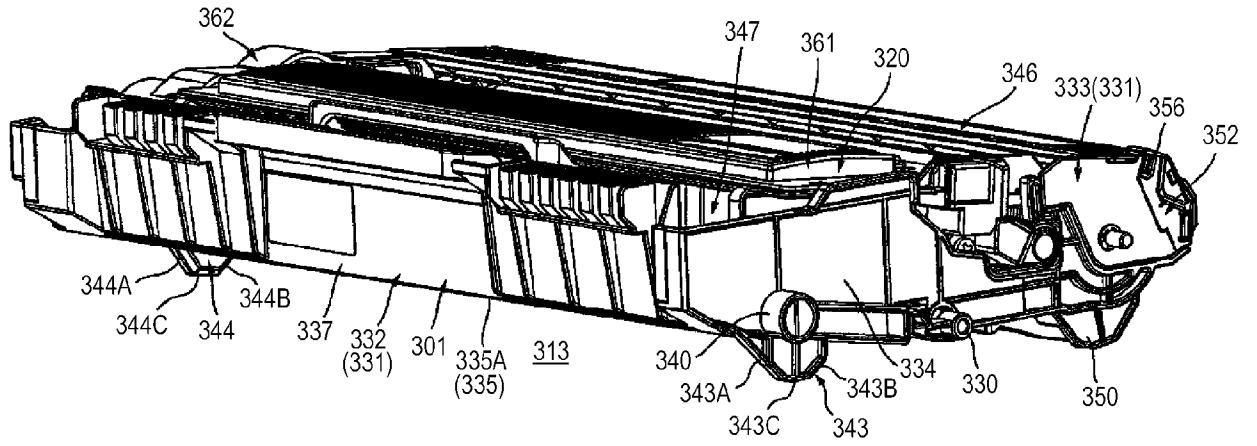
FIG. 18B is a perspective view of the process cartridge shown in FIG. 18A as seen from the right-upper side.

In order to mount the process cartridge 313 to the apparatus main body 312, an operator first mounts the developing cartridge 320 to the drum cartridge 301, as shown in FIGS. 18A and 18B.

In order to mount the developing cartridge 320 to the drum cartridge 301, the operator mounts the developing cartridge 320 in the developing cartridge mounting part 347 of the drum cartridge 301 so that the developing roller shaft collar 370 is fitted in the collar fitting part 338A.

Then, in order to mount the process cartridge 313 to the apparatus main body 312, the operator mounts the drum cartridge 301 including the developing cartridge 320 mounted thereto, i.e., the process cartridge 313 to the apparatus main body 312.

In order to mount the process cartridge 313 to the apparatus main body 312, the operator opens the front cover 317 and inserts the process cartridge 313 into the apparatus main body 312 from the rear end portion, as shown in FIG. 11.

Figure 19A:
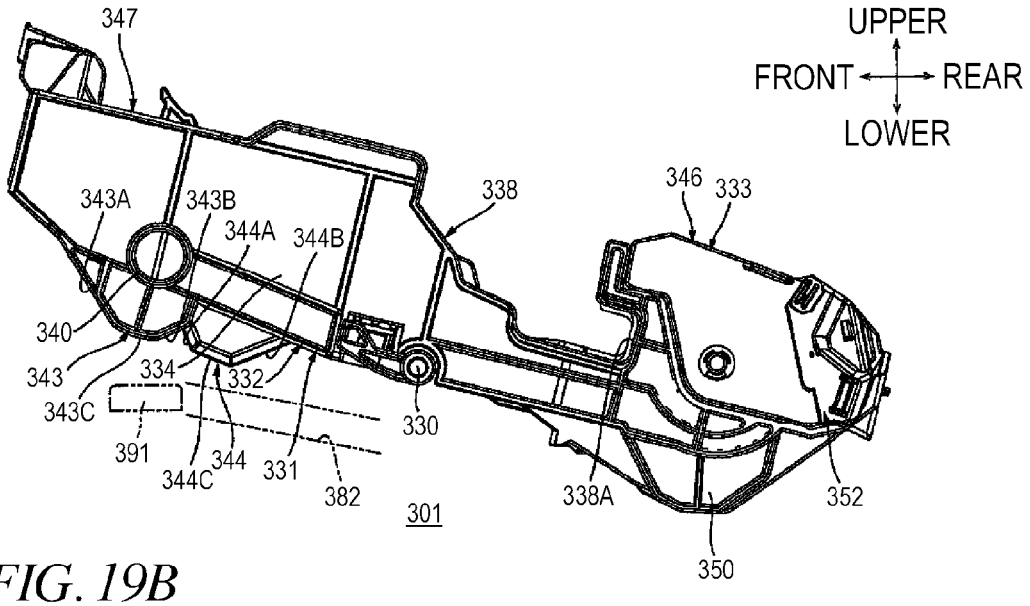
FIG. 19A illustrates an operation of the process cartridge being attached to the main body and shows a state in which a right rib and a left rib are fitted to a main body guide groove.
Figure 19B:
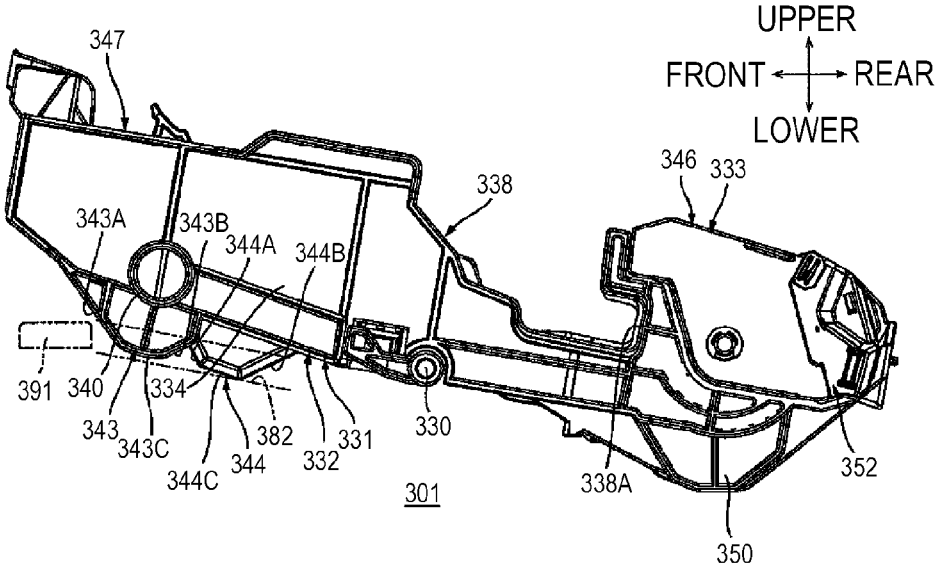
FIG. 19B illustrates an operation of the process cartridge being attached to the main body subsequent to FIG. 19A and shows a state in which a right rib and a left rib are fitted to a main body guide groove.

Then, as shown in FIGS. 19A and 19B, when the operator pushes in the process cartridge 313 rearwards, the left rib 344 is first fitted in a left recess 382 (refer to FIG. 20) in the apparatus main body 312. Subsequently to the left rib 344, the right rib 343 is then fitted in a right recess 382 (refer to FIG. 20) in the apparatus main body 312. That is, the left rib 344 and the right rib 343 are continuously fitted in the corresponding recesses 382 in the apparatus main body 312 at different timings.

Thereafter, when the operator further pushes in the process cartridge 313 rearwards, the mounting of the process cartridge 313 to the apparatus main body 312 is completed, as shown in FIG. 11.

Thereby, the left rib 344 is fitted in the left recess 382, so that the process cartridge 313 is positioned in the left-right direction in the apparatus main body 312. The drum gear 2A is meshed with a driving input gear (not shown) in the apparatus main body 312. The abutting boss 340 is positioned in the upper-lower direction in the apparatus main body 312.

Figure 20:
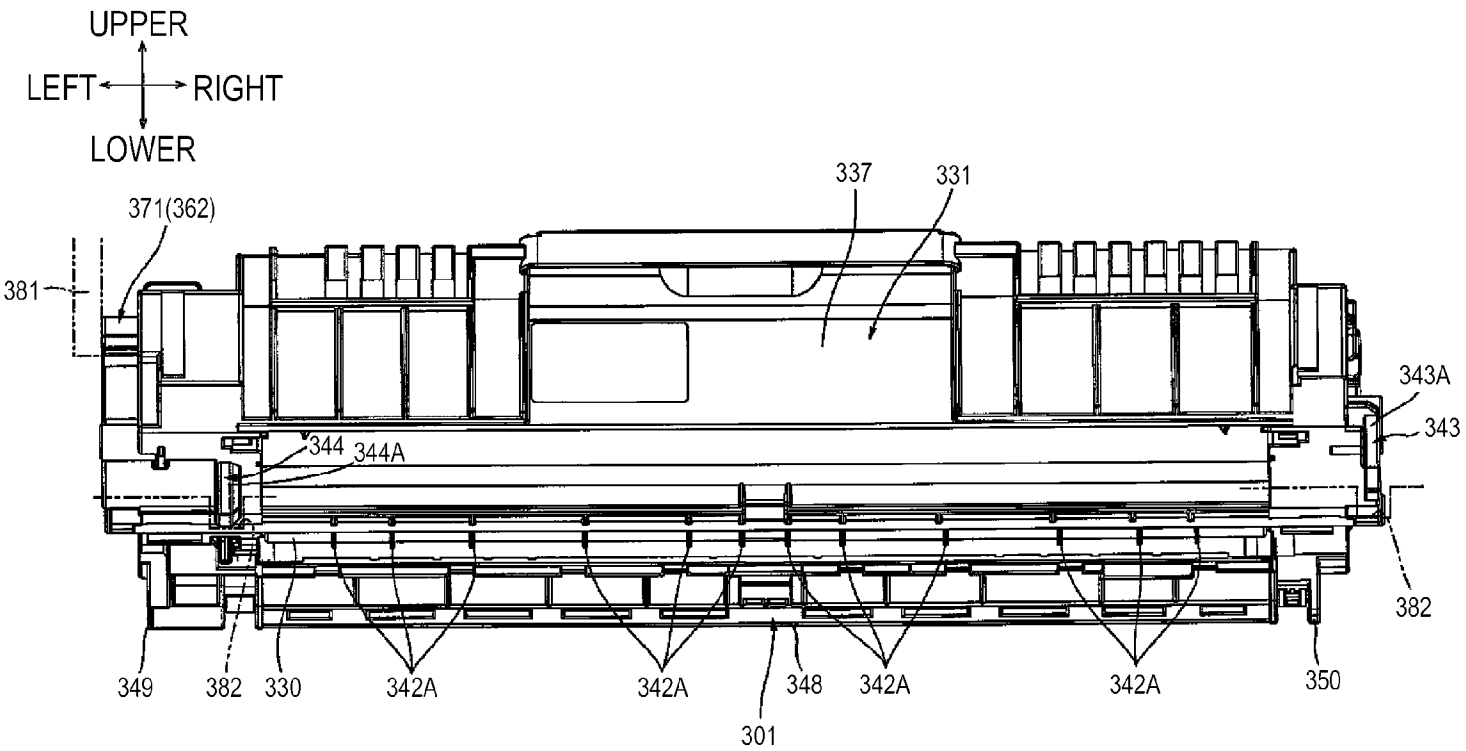
FIG. 20 is a front view of the process cartridge shown in FIG. 19B.

As shown in FIG. 20, the detection gear receiving part 371 of the developing cartridge 320 faces an actuator 381 in the apparatus main body 312, which is an example of the detection device, from the left.

After that, when the apparatus main body 312 starts a warming up operation, the driving force is input to the drum gear 302A, so that the photosensitive drum 302 is rotated. The driving force is input to the developing coupling 363, so that the developing roller 321, the supply roller 322, the agitator 325 and the detection gear 364 are rotated.

Thereby, as shown in FIGS. 17 and 20, the detection part 368 of the detection gear 364 advances leftwards from the exposed hole 372 of the detection gear receiving part 371 and is thus contacted to the actuator 381.

After starting the warming up operation, the apparatus main body 312 detects the contact of the detection gear 364 to the actuator 381 in a predetermined time, thereby determining that the unused developing cartridge 320 is mounted to the apparatus main body 312.

On the other hand, after starting the warming up operation, when the apparatus main body 312 does not detect the contact of the detection gear 364 to the actuator 381 in a predetermined time, the apparatus main body 312 determines that the completely used developing cartridge 320 or developing cartridge 320 being used is mounted to the apparatus main body 312.

In order to detach the process cartridge 313 from the apparatus main body 312, the operator opens the front cover 317 and pulls out the process cartridge 313 from the apparatus main body 312, according to a contrary process to the above-described mounting operation.

Here, as shown with a virtual line in FIG. 19B, a member 391 in the apparatus main body 312 may interfere with the right rib 343 or left rib 344 of the process cartridge 313.

In this case, the member 391 in the apparatus main body 12 abuts on the right rib 343 or left rib 344 from an upstream side with respect to the detaching direction of the process cartridge 313, i.e., from the front.

Thereby, as shown in FIG. 19A, while the process cartridge 313 is moved slightly upwards by a reactive force from the member 391 in the apparatus main body 312, it passes above the member 391 in the apparatus main body 312.

Thus, it is possible to smoothly perform the detaching operation of the process cartridge 313.

6. Operational Effects (1) As shown in FIG. 13, according to the drum cartridge 301 and the process cartridge 313, the lower end portion 344C of the left rib 344 and the lower end portion 343C of the right rib 343 are arranged at different positions in the front-rear direction.

For this reason, as shown in FIGS. 19A and 19B, when mounting the process cartridge 313 to the apparatus main body 312 along the front-rear direction, it is possible to bring the left rib 344 and the right rib 343 into contact with the apparatus main body 312 at different timings.

As a result, as compared to a configuration where the left rib 344 and the right rib 343 are contacted to the apparatus main body 312 at the same timing, it is possible to smoothly mount the drum cartridge 301 to the apparatus main body 312.

(2) As shown in FIG. 11, according to the drum cartridge 301 and the process cartridge 313, it is possible to guide the sheet P by using the sheet guide part 342 of the lower wall 335 of the drum cartridge 301, so that it is possible to reduce the number of components.

(3) According to the drum cartridge 301 and the process cartridge 313, the left rib 344 and the right rib 343 more protrude downwards than the conveyance ribs 342A of the sheet guide part 342.

For this reason, as shown in FIG. 13, when the drum cartridge 301 is horizontally placed, it is possible to prevent the conveyance ribs 342A of the sheet guide part 342 from contacting a placement surface.

As a result, it is possible to suppress the damage of the conveyance ribs 342A of the sheet guide part 342.

(4) As shown in FIG. 14, according to the drum cartridge 301 and the process cartridge 313, the left rib 344 is arranged at the rear and left of the right rib 343.

For this reason, as shown in FIG. 20, it is possible to easily position the drum gear 302A with respect to the apparatus main body 312 by fitting and positioning the left rib 344 in the recess 382 of the apparatus main body 312.

(5) As shown in FIG. 15, according to the drum cartridge 301 and the process cartridge 313, the front surface 344A of the left rib 344 is inclined downwards as it faces rearwards, as seen in the left-right direction.

For this reason, as shown in FIG. 19B, when detaching the process cartridge 313 from the apparatus main body 312, even though the member 391 in the apparatus main body 312 interferes with the left rib 344, it is possible to upwardly guide the drum cartridge 301 by the front surface 344A of the left rib 344 so that the drum cartridge 301 separates from the member 391 in the apparatus main body 312, as shown in FIG. 19A.

As a result, it is possible to more smoothly detach the process cartridge 313 from the apparatus main body 312.

(6) As shown in FIG. 13, according to the drum cartridge 301 and the process cartridge 313, the front surface 343A of the right rib 343 is inclined downwards as it faces rearwards, as seen in the left-right direction.

For this reason, as shown in FIG. 19B, when detaching the process cartridge 313 from the apparatus main body 312, even though the member 391 in the apparatus main body 312 interferes with the right rib 343, it is possible to upwardly guide the drum cartridge 301 by the front surface 343A of the right rib 343 so that the drum cartridge 301 separates from the member 391 in the apparatus main body 312, as shown in FIG. 19A.

As a result, it is possible to more smoothly detach the process cartridge 313 from the apparatus main body 312.

(7) As shown in FIG. 18B, according to the drum cartridge 301 and the process cartridge 313, the right rib 343 protrudes downwards from the abutting boss 340.

For this reason, it is possible to closely arrange the abutting boss 340 and the right rib 343, so that it is possible to make the drum cartridge 301 small.

(8) According to the drum cartridge 301 and the process cartridge 313, since the left rib 344 and the right rib 343 have the thickness (the size in the left-right direction) of 2 mm or greater, it is possible to secure the stiffness of the left rib 344 and right rib 343.

(9) As shown in FIG. 13, according to the drum cartridge 301 and the process cartridge 313, the front end portion of the left rib 344 overlaps with the rear end portion of the right rib 343, as seen in the left-right direction.

For this reason, since the left rib 344 and the right rib 343 are closely arranged, as seen in the left-right direction, it is possible to continuously bring the left rib 344 and the right rib 343 into contact with the apparatus main body 312 at different timings, as shown in FIGS. 19A and 19B.

As a result, it is possible to more smoothly mount the drum cartridge 301 to the apparatus main body 312.

(10) As shown in FIGS. 11 and 14, according to the drum cartridge 301 and the process cartridge 313, the left protrusion wall 349 and the right protrusion wall 350 are provided with the transfer roller 304 being interposed therebetween, in the left-right direction.

For this reason, when the drum cartridge 301 is horizontally placed, it is possible to stably place the drum cartridge 301 on the placement surface by bringing the right rib 343, the left rib 344, the left protrusion wall 349 and the right protrusion wall 350 into contact with the placement surface.

(11) As shown in FIG. 18A, according to the drum cartridge 301 and the process cartridge 313, the detection gear 364 that is detected by the actuator 381 of the apparatus main body 312 is provided at the same left as the left rib 344.

For this reason, it is possible to easily position the detection gear 364 with respect to the apparatus main body 312 by positioning the left rib 344 with respect to the apparatus main body 312.

(12) As shown in FIG. 14, according to the drum cartridge 301 and the process cartridge 313, the distance L1 between the lower end portion 343C of the right rib 343 and the front end portion 335A of the lower wall 335 in the front-rear direction is shorter than the distance L2 between the lower end portion 344C of the left rib 344 and the front end portion 335A of the lower wall 335 in the front-rear direction.

For this reason, as shown in FIGS. 19A and 19B, when mounting the process cartridge 313 to the apparatus main body 312 along the front-rear direction, it is possible to bring the left rib 344 and the right rib 343 into contact with the apparatus main body 312 at different timings.

As a result, as compared to a configuration where the left rib 344 and the right rib 343 are contacted to the apparatus main body 312 at the same timing, it is possible to smoothly mount the drum cartridge 301 to the apparatus main body 312.

8. Modified Embodiments

In the above illustrative first embodiment, the developing cartridge 3 includes the developing roller 12. However, the developing cartridge 3 may be configured to have a developing sleeve including a magnetic roller therein, instead of the developing roller 12, for example.

In the above illustrative embodiment, the first cover 131 and the second cover 132 are separately configured. However, the first cover 131 and the second cover 132 may also be integrally configured.

In the above illustrative embodiment, the second cover 132 is configured to cover the idle gear 116, the agitator gear 117 and the detection gear 120. However, the second cover 132 may be configured to cover at least a part of the idle gear 116, the agitator gear 117 and the detection gear 120.

In the above illustrative embodiment, the second cover 132 of the gear cover 112 includes the abutting part 143. However, the abutting part 143 may be configured as a separate member from the gear cover 112.

In the above illustrative embodiment, the detection gear 120 includes the gear part 122. However, the detection gear 120 may be configured to include a frictional member such as an elastic member, instead of the gear part 122, for example.

In the above illustrative embodiment, the left surface of the abutting part 143 is configured by the coupling surface 143D. However, the abutting part 143 may be configured to have an opened left side.

In the above illustrative embodiment, the left wall of the base part 140 of the second cover 132 is configured to be orthogonal to the left-right direction. However, it is not necessarily required that the left wall of the base part 140 of the second cover 132 be completely orthogonal to the left-right direction. That is, the left wall of the base part 140 of the second cover 132 may be configured to have only to cover the gear train 110 from the left. For example, the left wall of the base part 140 of the second cover 132 may be inclined relative to the sidewall 102 within a range not obstructing the rotations of the respective gears.

What is claimed is:

1. A process cartridge comprising:

a developing cartridge configured to receive therein developer; and a photosensitive member cartridge configured to detachably receive therein the developing cartridge, the process cartridge being configured to be detachably mounted to an image forming apparatus main body, wherein the photosensitive member cartridge comprises:

a photosensitive member, and a pressing member configured to press the developing cartridge towards the photosensitive member, wherein the developing cartridge is configured to be located at a first position at which the developing cartridge is pressed by the pressing member and at a second position at which the developing cartridge is separable from the photosensitive member cartridge, wherein the developing cartridge comprises:

a driving mechanism including a detected member configured to be applied with a driving force from a driving source provided for the image forming apparatus main body, the detected member being configured to be rotated by the applied driving force and to be detected by a detection device provided for the image forming apparatus main body, and a covering member configured to cover the driving mechanism, and wherein the covering member comprises:

a base part extending in a direction orthogonal to a first direction in which a rotational axis line of the detected member extends;

a receiving part protruding from the base part in the first direction and configured to receive at least a part of the detected member; and an abutting part protruding from the base part in the first direction and continuing to the receiving part, the abutting part being configured to abut on a member in the image forming apparatus main body and to move the developing cartridge to the first position when the process cartridge is mounted to the image forming apparatus main body at a state where the developing cartridge is located at the second position.

2. The process cartridge according to claim 1, wherein the developing cartridge comprises:

an agitation member configured to rotate about a first rotational axis line extending in the first direction to agitate the developer, and a first housing including a developer receiving chamber in which the agitation member is positioned, and wherein the abutting part is located at a position at which the abutting part overlaps with the developer receiving chamber in the first direction.

3. The process cartridge according to claim 2, wherein the first housing includes a first frame including the agitation member and a second frame joined to the first frame, and the abutting part is positioned closer to the second frame than the first rotational axis line in a second direction orthogonal to the first direction and in which the first and second frames face each other.

4. The process cartridge according to claim 3, wherein the developing cartridge further comprises a developing roller configured to rotate about a second rotational axis line extending in the first direction, and the abutting part is positioned closer to the second frame than a line connecting the first rotational axis line and the second rotational axis line.

5. The process cartridge according to claim 3, wherein the abutting part includes:

an abutting surface extending from the receiving part along a third direction orthogonal to both the first direction and the second direction and configured to abut on the member in the image forming apparatus main body;

a first reinforcement surface continuing to the abutting surface and extending in the second direction; and a second reinforcement surface extending in the third direction and connecting the first reinforcement surface and the receiving part.

6. The process cartridge according to claim 5, wherein the base part includes an opening overlapping with a rotational shaft of the agitation member in the first direction, and the second reinforcement surface has a shape conforming to a peripheral edge portion of the opening.

7. The process cartridge according to claim 5, wherein the abutting part includes a coupling surface configured to couple an edge portion of the abutting surface, an edge portion of the first reinforcement surface and an edge portion of the second reinforcement surface in the first direction.

8. The process cartridge according to claim 5, wherein an angle between the abutting surface and the receiving part is obtuse, when projected in the first direction.

9. The process cartridge according to claim 3, wherein the driving mechanism comprises a force-receiving member configured to be applied with a driving force from an outside, and at least a part of the abutting part is positioned at an outer side of the force-receiving member in the first direction.

10. The process cartridge according to claim 3, wherein the photosensitive member cartridge further comprises a second housing including a cartridge receiving part configured to detachably receive therein the developing cartridge, and the pressing member comprises:

a main body part configured to be engaged with the second housing, a pressing part protruding from the main body part towards the photosensitive member in a pressing direction in which the pressing member presses the developing cartridge, and configured to contact the developing cartridge received in the cartridge receiving part, and a protrusion part protruding from the main body part towards the photosensitive member in the pressing direction, protruding from the main body part in the second direction, and including a guide surface continuing to the pressing part and configured to guide the developing cartridge to the cartridge receiving part.

11. The process cartridge according to claim 10, wherein the protrusion part includes a curved surface positioned at an opposite side to the main body part in the second direction and continuing to the guide surface.

12. The process cartridge according to claim 10, wherein the guide surface is inclined so that the guide surface is more spaced from the photosensitive member as the guide surface protrudes in the second direction, as seen from the first direction, and wherein an angle between the guide surface and the pressing direction is 45° or greater and less than 90°.

13. The process cartridge according to claim 10, wherein the guide surface continues to the pressing part, and overlaps with the pressing part, when projected in the second direction.

14. The process cartridge according to claim 1, wherein a part of the covering member is located between the abutting part and the detected member.

15. The process cartridge according to claim 1, a moving direction in which the developing cartridge is moved from the second position to the first position is different from an insert direction in which the process cartridge is inserted into the image forming apparatus main body.

* * * * *